US010089999B2

(12) United States Patent
Xu

(10) Patent No.: US 10,089,999 B2
(45) Date of Patent: Oct. 2, 2018

(54) FREQUENCY DOMAIN NOISE DETECTION OF AUDIO WITH TONE PARAMETER

(71) Applicant: Huawei Technologies Co., Ltd., Shenzhen (CN)

(72) Inventor: Lijing Xu, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 43 days.

(21) Appl. No.: 15/380,163

(22) Filed: Dec. 15, 2016

(65) Prior Publication Data

US 2017/0098455 A1 Apr. 6, 2017

Related U.S. Application Data

(63) Continuation of application No. PCT/CN2015/071725, filed on Jan. 28, 2015.

(30) Foreign Application Priority Data

Jul. 10, 2014 (CN) ..... 2014 1 0326739

(51) Int. Cl.
*G10L 25/84* (2013.01)
*G10L 21/0232* (2013.01)
(Continued)

(52) U.S. Cl.
CPC ..... *G10L 21/0232* (2013.01); *G10L 25/21* (2013.01); *G10L 25/84* (2013.01); *G10L 25/18* (2013.01); *G10L 25/90* (2013.01)

(58) Field of Classification Search
CPC ..... G10L 25/78; G10L 25/84; G10L 2021/02087; G10L 2025/783; G10L 2025/932; G10L 2025/937
(Continued)

(56) References Cited

U.S. PATENT DOCUMENTS 5,680,130 A 10/1997 Tsutsui et al.
5,680,508 A 10/1997 Liu
(Continued)

FOREIGN PATENT DOCUMENTS

CN 1103141 C 3/2003
CN 1758331 A 4/2006
(Continued)

OTHER PUBLICATIONS

Machine Translation and Abstract of Chinese Publication No. CN1758331, dated Apr. 12, 2006, 7 pages.
(Continued)

*Primary Examiner* — Martin Lerner
(74) *Attorney, Agent, or Firm* — Conley Rose, P.C.

(57) ABSTRACT

A noise detection method and apparatus are disclosed. The noise detection method includes: obtaining a frequency-domain energy distribution parameter of a current frame of an audio signal, and obtaining a frequency-domain energy distribution parameter; obtaining a tone parameter of the current frame, and obtaining a tone parameter; determining, according to the tone parameter of the current frame and the tone parameter of each of the frames in the preset neighboring domain range of the current frame, whether the current frame is in a speech section or a non-speech section; and determining that the current frame is speech-grade noise if the current frame is in a speech section and a quantity of frequency-domain energy distribution parameters falling within a preset speech-grade noise frequency-domain energy distribution parameter interval in all the frequency-domain energy distribution parameters is greater than or equal to a first threshold.

9 Claims, 9 Drawing Sheets

(51) Int. Cl.
*G10L 25/21* (2013.01)
*G10L 25/90* (2013.01)
*G10L 25/18* (2013.01)

(58) Field of Classification Search
USPC ..... 704/205, 207, 201, 215, 226
See application file for complete search history.

(56) References Cited

U.S. PATENT DOCUMENTS

| | | | | |
|---|---|---|---|---|
| 5,774,837 | A | 6/1998 | Yeldener et al. | |
| 5,995,924 | A | 11/1999 | Terry | |
| 6,023,674 | A | 2/2000 | Mekuria | |
| 6,263,306 | B1 * | 7/2001 | Fee | G10L 15/02 704/203 |
| 8,682,664 | B2 * | 3/2014 | Xu | G10L 25/78 704/206 |
| 8,818,811 | B2 * | 8/2014 | Wang | G10L 25/78 704/210 |
| 9,396,739 | B2 * | 7/2016 | Xu | G10L 25/93 |
| 9,734,841 | B2 * | 8/2017 | Yamabe | G10L 21/0232 |
| 2002/0103636 | A1 * | 8/2002 | Tucker | G10L 25/78 704/205 |
| 2005/0038651 | A1 * | 2/2005 | Zhang | G10L 25/78 704/233 |
| 2005/0267745 | A1 | 12/2005 | Laaksonen et al. | |
| 2006/0053007 | A1 * | 3/2006 | Niemisto | G10L 25/78 704/233 |
| 2007/0096961 | A1 * | 5/2007 | Sakiyama | G10L 21/04 341/76 |
| 2010/0094625 | A1 * | 4/2010 | Mohammad | G10L 25/48 704/233 |
| 2012/0016677 | A1 * | 1/2012 | Xu | G10L 25/78 704/270 |
| 2012/0095755 | A1 | 4/2012 | Otani et al. | |
| 2012/0130713 | A1 * | 5/2012 | Shin | G10L 25/78 704/233 |
| 2012/0209604 | A1 * | 8/2012 | Sehlstedt | G10L 25/78 704/233 |
| 2014/0316775 | A1 * | 10/2014 | Furuta | G10L 21/0208 704/226 |
| 2015/0012273 | A1 * | 1/2015 | Espy-Wilson | G10L 25/90 704/237 |
| 2015/0032447 | A1 * | 1/2015 | Gunawan | G10L 25/84 704/233 |
| 2017/0076739 | A1 * | 3/2017 | Xu | H04M 1/24 |

FOREIGN PATENT DOCUMENTS

| | | | |
|---|---|---|---|
| CN | 1985301 | A | 6/2007 |
| CN | 101221757 | A | 7/2008 |
| CN | 101645265 | A | 2/2010 |
| CN | 101872616 | A | 10/2010 |
| CN | 102804260 | A | 11/2012 |
| CN | 103903633 | A | 7/2014 |
| EP | 0713295 | A1 | 5/1996 |
| EP | 2444966 | A1 | 4/2012 |

OTHER PUBLICATIONS

Machine Translation and Abstract of Chinese Publication No. CN101221757, dated Jul. 16, 2008, 6 pages.
Machine Translation and Abstract of Chinese Publication No. CN101645265, dated Feb. 10, 2010, 8 pages.
Machine Translation and Abstract of Chinese Publication No. CN101872616, dated Oct. 27, 2010, 17 pages.
Foreign Communication From a Counterpart Application, European Application No. 15818398.8, Extended European Search Report dated Feb. 3, 2017, 8 pages.
Foreign Communication From a Counterpart Application, PCT Application No. PCT/CN2015/071725, English Translation of International Search Report dated Mar. 27, 2015, 3 pages.
Foreign Communication From a Counterpart Application, PCT Application No. PCT/CN2015/071725, English Translation of Written Opinion dated Mar. 27, 2015, 11 pages.
Foreign Communication From a Counterpart Application, Chinese Application No. 201410326739.1, Chinese Office Action dated Jun. 14, 2018, 7 pages.

* cited by examiner

FREQUENCY DOMAIN NOISE DETECTION OF AUDIO WITH TONE PARAMETER

CROSS-REFERENCE TO RELATED APPLICATIONS

This application is a continuation of International Application No. PCT/CN2015/071725, filed on Jan. 28, 2015, which claims priority to Chinese Patent Application No. 201410326739.1, filed on Jul. 10, 2014, both of which are hereby incorporated by reference in their entireties.

TECHNICAL FIELD

Embodiments of the present disclosure relate to audio signal processing technologies, and in particular, to a noise detection method and apparatus.

BACKGROUND

During transmission of an audio signal, noise may be caused due to various reasons. When severe noise occurs in an audio signal, normal use of a user is affected. Therefore, noise in an audio signal needs to be detected in time, so as to eliminate noise affecting normal use.

In an existing noise detection method, a time-domain signal of an audio signal is analyzed, which focuses on analysis of a parameter related to time-domain energy variations of the audio signal. However, time-domain energy variations of some noise signals are normal, making it difficult to detect these noise signals using the existing noise detection method.

FIG. 1 is a time-domain waveform graph of a speech signal, where a horizontal axis is a sample point, and a vertical axis is a normalized amplitude. In the speech signal shown in FIG. 1, speech-grade noise is on a left side of a dashed line 11, a first section of normal speech is between the dashed line 11 and a dashed line 12, a metallic sound is between the dashed line 12 and a dashed line 13, a second section of normal speech is between the dashed line 13 and a dashed line 14, and background noise is on a right side of the dashed line 14. The speech-grade noise is a type of special noise, and a normal speech signal may be indistinguishable or may sound unnatural due to occurrence of speech-grade noise. The metallic sound is noise sounds like a metallic effect, and is relatively high-pitched. The speech-grade noise, the metallic sound, and the background noise all are noise signals. However, it can be learned from FIG. 1 that only the metallic sound has a relatively large amplitude variation, and waveforms of the speech-grade noise and the background noise are relatively similar to a waveform of a normal speech signal. Therefore, according to a time-domain waveform of a speech signal, it is difficult to distinguish such noise whose waveform is similar to that of a normal speech signal from the normal speech signal.

It can be seen that the existing noise detection method is applicable only to detection of a signal having short duration, a relatively large energy variation, and a sudden variation, and has low accuracy in detecting noise whose time-domain signal characteristic is similar to that of a normal speech signal.

SUMMARY

Embodiments of the present disclosure provide a noise detection method and apparatus, which can improve noise detection accuracy of an audio signal through analysis of frequency-domain energy of the audio signal.

According to a first aspect, a noise detection method is provided, including obtaining a frequency-domain energy distribution parameter of a current frame of an audio signal, and obtaining a frequency-domain energy distribution parameter of each of frames in a preset neighboring domain range of the current frame; obtaining a tone parameter of the current frame, and obtaining a tone parameter of each of the frames in the preset neighboring domain range of the current frame; determining, according to the tone parameter of the current frame and the tone parameter of each of the frames in the preset neighboring domain range of the current frame, whether the current frame is in a speech section or a non-speech section; and determining that the current frame is speech-grade noise if the current frame is in a speech section and a quantity of frequency-domain energy distribution parameters falling within a preset speech-grade noise frequency-domain energy distribution parameter interval in all the frequency-domain energy distribution parameters is greater than or equal to a first threshold.

With reference to the first aspect, in a first possible implementation manner of the first aspect, the frequency-domain energy distribution parameter is a derivative maximum value distribution parameter of a frequency-domain energy distribution ratio, and the obtaining a frequency-domain energy distribution parameter of a current frame of an audio signal includes obtaining a frequency-domain energy distribution ratio of the current frame; calculating a derivative of the frequency-domain energy distribution ratio of the current frame; and obtaining a derivative maximum value distribution parameter of the frequency-domain energy distribution ratio of the current frame according to the derivative of the frequency-domain energy distribution ratio of the current frame; the obtaining a frequency-domain energy distribution parameter of each of frames in a preset neighboring domain range of the current frame includes obtaining a frequency-domain energy distribution ratio of each of the frames in the preset neighboring domain range of the current frame; calculating a derivative of the frequency-domain energy distribution ratio of each of the frames in the preset neighboring domain range of the current frame; and obtaining a derivative maximum value distribution parameter of the frequency-domain energy distribution ratio of each of the frames in the preset neighboring domain range of the current frame according to the derivative of the frequency-domain energy distribution ratio of each of the frames in the preset neighboring domain range of the current frame; and the determining that the current frame is speech-grade noise if the current frame is in a speech section and a quantity of frequency-domain energy distribution parameters falling within a preset speech-grade noise frequency-domain energy distribution parameter interval in all the frequency-domain energy distribution parameters is greater than or equal to a first threshold includes determining that the current frame is speech-grade noise if the current frame is in a speech section and a quantity of derivative maximum value distribution parameters of frequency-domain energy distribution ratios that fall within a preset derivative maximum value distribution parameter interval of speech-grade noise frequency-domain energy distribution ratios in all derivative maximum value distribution parameters of the frequency-domain energy distribution ratios is greater than or equal to a second threshold.

With reference to the first aspect, in a second possible implementation manner of the first aspect, the frequency-domain energy distribution parameter includes a frequency-domain energy distribution ratio and a derivative maximum value distribution parameter of the frequency-domain energy distribution ratio, and the obtaining a frequency-domain energy distribution parameter of a current frame of an audio signal includes obtaining a frequency-domain energy distribution ratio of the current frame; calculating a derivative of the frequency-domain energy distribution ratio of the current frame; and obtaining a derivative maximum value distribution parameter of the frequency-domain energy distribution ratio of the current frame according to the derivative of the frequency-domain energy distribution ratio of the current frame; the obtaining a frequency-domain energy distribution parameter of each of frames in a preset neighboring domain range of the current frame includes obtaining a frequency-domain energy distribution ratio of each of the frames in the preset neighboring domain range of the current frame; calculating a derivative of the frequency-domain energy distribution ratio of each of the frames in the preset neighboring domain range of the current frame; and obtaining a derivative maximum value distribution parameter of the frequency-domain energy distribution ratio of each of the frames in the preset neighboring domain range of the current frame according to the derivative of the frequency-domain energy distribution ratio of each of the frames in the preset neighboring domain range of the current frame; and the determining that the current frame is speech-grade noise if the current frame is in a speech section and a quantity of frequency-domain energy distribution parameters falling within a preset speech-grade noise frequency-domain energy distribution parameter interval in all the frequency-domain energy distribution parameters is greater than or equal to a first threshold includes determining that the current frame is speech-grade noise if the current frame is in a speech section, a quantity of derivative maximum value distribution parameters of frequency-domain energy distribution ratios that fall within a preset derivative maximum value distribution parameter interval of speech-grade noise frequency-domain energy distribution ratios in all derivative maximum value distribution parameters of the frequency-domain energy distribution ratios is greater than or equal to the second threshold, and a quantity of frequency-domain energy distribution ratios falling within a preset speech-grade noise frequency-domain energy distribution ratio interval in all the frequency-domain energy distribution ratios is greater than or equal to a third threshold.

With reference to the first aspect, in a third possible implementation manner of the first aspect, the method further includes using the current frame and each frame in the preset neighboring domain range of the current frame as a frame set; using each frame in the frame set as the current frame, and obtaining a quantity N of frames in the frame set, where the frames are in a non-speech section, a quantity of frequency-domain energy distribution parameters falling within a preset non-speech-grade noise frequency-domain energy distribution parameter interval in all the frequency-domain energy distribution parameters is greater than or equal to a fourth threshold, and N is a positive integer; and determining that the current frame is non-speech-grade noise if N is greater than or equal to a fifth threshold.

With reference to the third possible implementation manner of the first aspect, in a fourth possible implementation manner of the first aspect, the frequency-domain energy distribution parameter is a derivative maximum value distribution parameter of a frequency-domain energy distribution ratio, and the obtaining a frequency-domain energy distribution parameter of a current frame of an audio signal includes obtaining a frequency-domain energy distribution ratio of the current frame; calculating a derivative of the frequency-domain energy distribution ratio of the current frame; and obtaining a derivative maximum value distribution parameter of the frequency-domain energy distribution ratio of the current frame according to the derivative of the frequency-domain energy distribution ratio of the current frame; the obtaining a frequency-domain energy distribution parameter of each of frames in a preset neighboring domain range of the current frame includes obtaining a frequency-domain energy distribution ratio of each of the frames in the preset neighboring domain range of the current frame; calculating a derivative of the frequency-domain energy distribution ratio of each of the frames in the preset neighboring domain range of the current frame; and obtaining a derivative maximum value distribution parameter of the frequency-domain energy distribution ratio of each of the frames in the preset neighboring domain range of the current frame according to the derivative of the frequency-domain energy distribution ratio of each of the frames in the preset neighboring domain range of the current frame; the obtaining a quantity N of frames in the frame set, where the frames are in a non-speech section, a quantity of frequency-domain energy distribution parameters falling within a preset non-speech-grade noise frequency-domain energy distribution parameter interval in all the frequency-domain energy distribution parameters is greater than or equal to a fourth threshold, and N is a positive integer includes obtaining a quantity M of frames in the frame set, where the frames are in a non-speech section, total frequency-domain energy is greater than or equal to a sixth threshold, a quantity of derivative maximum value distribution parameters of frequency-domain energy distribution ratios that fall within a preset derivative maximum value distribution parameter interval of non-speech-grade noise frequency-domain energy distribution ratios in all derivative maximum value distribution parameters of the frequency-domain energy distribution ratios is greater than or equal to a seventh threshold, and M is a positive integer; and the determining that the current frame is non-speech-grade noise if N is greater than or equal to a fifth threshold includes determining that the current frame is non-speech-grade noise if M is greater than or equal to an eighth threshold.

With reference to any possible implementation manner of the first aspect to the fourth possible implementation manner of the first aspect, in a fifth possible implementation manner of the first aspect, the obtaining a tone parameter of the current frame, and obtaining a tone parameter of each of the frames in the preset neighboring domain range of the current frame includes obtaining a largest tone quantity value, where the largest tone quantity value is a tone quantity of a frame whose tone quantity is the largest among the current frame and the frames in the preset neighboring domain range of the current frame; and the determining, according to the tone parameter of the current frame and the tone parameter of each of the frames in the preset neighboring domain range of the current frame, whether the current frame is in a speech section or a non-speech section includes, if the largest tone quantity value is greater than or equal to a preset speech threshold, determining that the current frame is in a speech section, or if the largest tone quantity value is smaller than a preset speech threshold, determining that the current frame is in a non-speech section.

According to a second aspect, a noise detection apparatus is provided, including an obtaining module configured to obtain a frequency-domain energy distribution parameter of a current frame of an audio signal, and obtain a frequency-domain energy distribution parameter of each of frames in a preset neighboring domain range of the current frame; obtain a tone parameter of the current frame, and obtain a tone parameter of each of the frames in the preset neighboring domain range of the current frame; and determine, according to the tone parameter of the current frame and the tone parameter of each of the frames in the preset neighboring domain range of the current frame, whether the current frame is in a speech section or a non-speech section; and a detection module configured to determine that the current frame is speech-grade noise if the current frame is in a speech section and a quantity of frequency-domain energy distribution parameters falling within a preset speech-grade noise frequency-domain energy distribution parameter interval in all the frequency-domain energy distribution parameters is greater than or equal to a first threshold.

With reference to the second aspect, in a first possible implementation manner of the second aspect, the frequency-domain energy distribution parameter is a derivative maximum value distribution parameter of a frequency-domain energy distribution ratio, and the obtaining module is configured to obtain a frequency-domain energy distribution ratio of the current frame; calculate a derivative of the frequency-domain energy distribution ratio of the current frame; obtain a derivative maximum value distribution parameter of the frequency-domain energy distribution ratio of the current frame according to the derivative of the frequency-domain energy distribution ratio of the current frame; obtain a frequency-domain energy distribution ratio of each of the frames in the preset neighboring domain range of the current frame; calculate a derivative of the frequency-domain energy distribution ratio of each of the frames in the preset neighboring domain range of the current frame; and obtain a derivative maximum value distribution parameter of the frequency-domain energy distribution ratio of each of the frames in the preset neighboring domain range of the current frame according to the derivative of the frequency-domain energy distribution ratio of each of the frames in the preset neighboring domain range of the current frame; and the detection module is configured to determine that the current frame is speech-grade noise if the current frame is in a speech section and a quantity of derivative maximum value distribution parameters of frequency-domain energy distribution ratios that fall within a preset derivative maximum value distribution parameter interval of speech-grade noise frequency-domain energy distribution ratios in all derivative maximum value distribution parameters of the frequency-domain energy distribution ratios is greater than or equal to a second threshold.

With reference to the second aspect, in a second possible implementation manner of the second aspect, the frequency-domain energy distribution parameter includes a frequency-domain energy distribution ratio and a derivative maximum value distribution parameter of the frequency-domain energy distribution ratio, and the obtaining module is configured to obtain a frequency-domain energy distribution ratio of the current frame; calculate a derivative of the frequency-domain energy distribution ratio of the current frame; obtain a derivative maximum value distribution parameter of the frequency-domain energy distribution ratio of the current frame according to the derivative of the frequency-domain energy distribution ratio of the current frame; obtain a frequency-domain energy distribution ratio of each of the frames in the preset neighboring domain range of the current frame; calculate a derivative of the frequency-domain energy distribution ratio of each of the frames in the preset neighboring domain range of the current frame; and obtain a derivative maximum value distribution parameter of the frequency-domain energy distribution ratio of each of the frames in the preset neighboring domain range of the current frame according to the derivative of the frequency-domain energy distribution ratio of each of the frames in the preset neighboring domain range of the current frame; and the detection module is configured to determine that the current frame is speech-grade noise if the current frame is in a speech section, a quantity of derivative maximum value distribution parameters of frequency-domain energy distribution ratios that fall within a preset derivative maximum value distribution parameter interval of speech-grade noise frequency-domain energy distribution ratios in all derivative maximum value distribution parameters of the frequency-domain energy distribution ratios is greater than or equal to the second threshold, and a quantity of frequency-domain energy distribution ratios falling within a preset speech-grade noise frequency-domain energy distribution ratio interval in all the frequency-domain energy distribution ratios is greater than or equal to a third threshold.

With reference to the second aspect, in a third possible implementation manner of the second aspect, the detection module is further configured to use the current frame and each frame in the preset neighboring domain range of the current frame as a frame set; use each frame in the frame set as the current frame, and obtain a quantity N of frames in the frame set, where the frames are in a non-speech section, a quantity of frequency-domain energy distribution parameters falling within a preset non-speech-grade noise frequency-domain energy distribution parameter interval in all the frequency-domain energy distribution parameters is greater than or equal to a fourth threshold, and N is a positive integer; and determine that the current frame is non-speech-grade noise if N is greater than or equal to a fifth threshold.

With reference to the third possible implementation manner of the second aspect, in a fourth possible implementation manner of the second aspect, the frequency-domain energy distribution parameter is a derivative maximum value distribution parameter of a frequency-domain energy distribution ratio, and the obtaining module is configured to obtain a frequency-domain energy distribution ratio of the current frame; calculate a derivative of the frequency-domain energy distribution ratio of the current frame; obtain a derivative maximum value distribution parameter of the frequency-domain energy distribution ratio of the current frame according to the derivative of the frequency-domain energy distribution ratio of the current frame; obtain a frequency-domain energy distribution ratio of each of the frames in the preset neighboring domain range of the current frame; calculate a derivative of the frequency-domain energy distribution ratio of each of the frames in the preset neighboring domain range of the current frame; and obtain a derivative maximum value distribution parameter of the frequency-domain energy distribution ratio of each of the frames in the preset neighboring domain range of the current frame according to the derivative of the frequency-domain energy distribution ratio of each of the frames in the preset neighboring domain range of the current frame; and the detection module is configured to obtain a quantity M of frames in the frame set, where the frames are in a non-speech section, total frequency-domain energy is greater than or equal to a sixth threshold, a quantity of derivative maximum value distribution parameters of frequency-domain energy distribution ratios that fall within a preset derivative maximum value distribution parameter interval of non-speech-grade noise frequency-domain energy distribution ratios in all derivative maximum value distribution parameters of the frequency-domain energy distribution ratios is greater than or equal to a seventh threshold, and M is a positive integer; and determine that the current frame is non-speech-grade noise if M is greater than or equal to an eighth threshold.

With reference to any possible implementation manner of the second aspect to the fourth possible implementation manner of the second aspect, in a fifth possible implementation manner of the second aspect, the obtaining module is configured to obtain a largest tone quantity value, where the largest tone quantity value is a tone quantity of a frame whose tone quantity is the largest among the current frame and the frames in the preset neighboring domain range of the current frame; and if the largest tone quantity value is greater than or equal to a preset speech threshold, determine that the current frame is in a speech section, or if the largest tone quantity value is smaller than a preset speech threshold, determine that the current frame is in a non-speech section.

According to the noise detection method and apparatus provided in the embodiments of the present disclosure, a frequency-domain energy parameter and a tone parameter of a current frame and a frequency-domain energy distribution parameter and a tone parameter of each of frames in a preset neighboring domain range of the current frame are obtained; it is determined, according to the tone parameters, whether the current frame is in a speech section; and it is determined, according to the frequency-domain energy distribution parameters, whether the current frame is speech-grade noise. A method for detecting noise of an audio signal according to a frequency-domain energy variation of the audio signal is provided, so that noise detection accuracy of an audio signal can be improved.

BRIEF DESCRIPTION OF DRAWINGS

To describe the technical solutions in the embodiments of the present disclosure more clearly, the following briefly introduces the accompanying drawings required for describing the embodiments. Apparently, the accompanying drawings in the following description show some embodiments of the present disclosure, and a person of ordinary skill in the art may still derive other drawings from these accompanying drawings without creative efforts.

DESCRIPTION OF EMBODIMENTS

To make the objectives, technical solutions, and advantages of the embodiments of the present disclosure clearer, the following clearly describes the technical solutions in the embodiments of the present disclosure with reference to the accompanying drawings in the embodiments of the present disclosure. Apparently, the described embodiments are a part rather than all of the embodiments of the present disclosure. All other embodiments obtained by a person of ordinary skill in the art based on the embodiments of the present disclosure without creative efforts shall fall within the protection scope of the present disclosure.

Noise in an audio signal may be caused due to multiple reasons, for example, caused due to a failure of a digital signal processing (DSP) core, or due to a packet loss, or due to a noisy sound. Overall, the noise in the audio signal is mainly classified into two types. One type is speech-grade noise, where a normal speech signal changes into speech-grade noise due to various reasons, and the normal speech signal may be indistinguishable or may sound unnatural. The other type is non-speech-grade noise, such as a metallic sound, some background noise, radio channel switching noise, or the like.

In an existing method for detecting noise in an audio signal, a time-domain energy analysis method is used, and a signal with a sudden time-domain energy variation is detected as noise. However, the speech-grade noise and some non-speech-grade noise (for example, a metallic sound) do not have a sudden time-domain energy variation. Therefore, the noise cannot be detected using the existing noise detection method.

It can be learned through analysis that occurrence of noise does not necessarily indicate occurrence of time-domain energy abnormality, but is generally followed by frequency-domain energy abnormality. Therefore, the embodiments of the present disclosure provide a noise detection method, where noise in an audio signal is detected through analysis of a frequency-domain energy variation of the audio signal.

Figure 1:
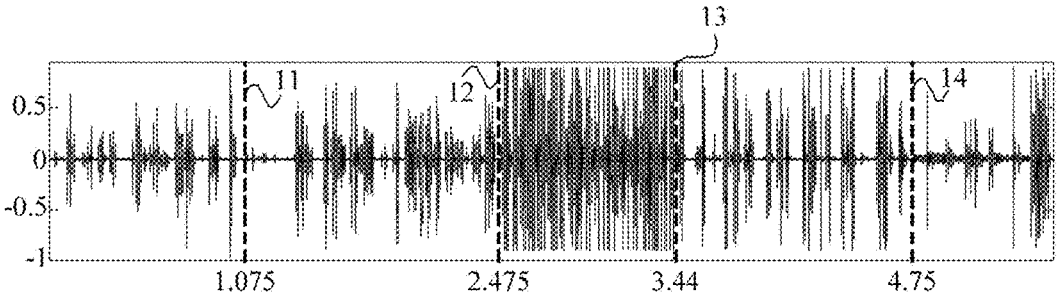
FIG. 1 is a time-domain waveform graph of a speech signal.
Figure 2:
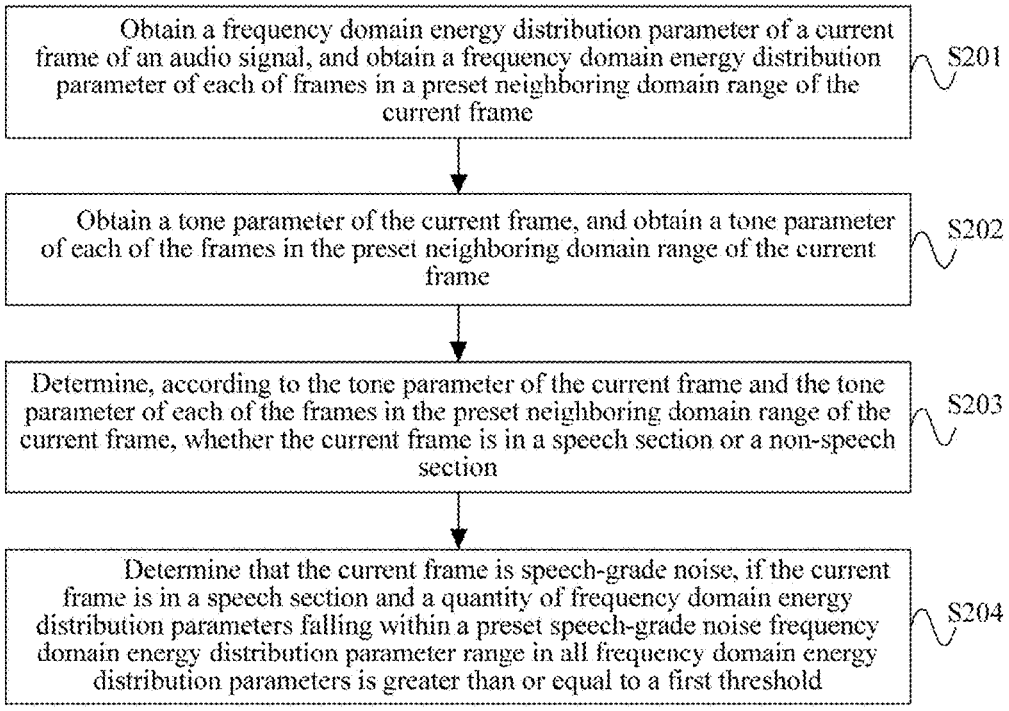
FIG. 2 is a flowchart of Embodiment 1 of a noise detection method according to an embodiment of the present disclosure.

FIG. 2 is a flowchart of Embodiment 1 of a noise detection method according to an embodiment of the present disclosure. As shown in FIG. 2, the method in this embodiment includes the following steps.

Step S201: Obtain a frequency-domain energy distribution parameter of a current frame of an audio signal, and obtain a frequency-domain energy distribution parameter of each of frames in a preset neighboring domain range of the current frame.

According to the noise detection method provided in this embodiment, whether each frame of an audio signal is noise is determined through analysis of frequency-domain energy of the audio signal. However, it can be learned according to a characteristic of an audio signal that a normal signal or a noise signal in the audio signal generally includes a section of continuous frames, where frequency-domain energy distribution of some frames in a normal audio signal may be the same as that of a noise signal, and frequency-domain energy distribution of some frames in a noise signal may be the same as that of a normal audio signal. If a frame or limited frames of an audio signal have frequency-domain energy abnormality, the frame(s) may not be noise. Therefore, during detection of an audio signal, although frames in the audio signal are detected one by one, analysis needs to be performed using related parameters of both each frame and several neighboring frames of the frame, to obtain a detection result of each frame.

Therefore, according to the noise detection method provided in this embodiment, although each frame of the audio signal is detected, the frequency-domain energy distribution parameter of the current frame and the frequency-domain energy distribution parameter of each of the frames in the preset neighboring domain range of the current frame need to be obtained first. Generally, the audio signal is represented in a form of a time-domain signal. To obtain a frequency-domain energy distribution parameter of the audio signal, first, fast Fourier transformation (FFT) needs to be performed on the audio signal in a time-domain form, to obtain a frequency-domain representation form of the audio signal.

Then, a frequency domain of the audio signal is analyzed. A frequency-domain energy variation trend is mainly analyzed, to obtain the frequency-domain energy distribution parameter of the current frame and the frequency-domain energy distribution parameter of each of the frames in the preset neighboring domain range of the current frame. The frequency-domain energy distribution parameter of the current frame and the frequency-domain energy distribution parameter of each of the frames in the preset neighboring domain range of the current frame represent various parameters related to frequency-domain energy of the current frame and each of the frames in the preset neighboring domain range of the current frame. The parameters include but are not limited to frequency-domain energy distribution characteristics, frequency-domain energy variation trends, distribution characteristics of derivative maximum value distribution parameters of frequency-domain energy distribution ratios, and the like of the current frame and each of the frames in the preset neighboring domain range of the current frame.

Step S202: Obtain a tone parameter of the current frame, and obtain a tone parameter of each of the frames in the preset neighboring domain range of the current frame.

Since noise in an audio signal is classified into speech-grade noise and non-speech-grade noise, and for the speech-grade noise and the non-speech-grade noise, their frequency-domain energy distribution characteristics differ, whether the current frame is noise cannot be very accurately determined according only to the frequency-domain energy distribution parameter of the current frame and the frequency-domain energy distribution parameter of each of the frames in the preset neighboring domain range of the current frame. In an audio signal, a part including a speech signal is referred to as a speech section, and a part including a non-speech signal is referred to as a non-speech section. In terms of a frequency-domain characteristic of the audio signal, the speech section and the non-speech section in the audio signal mainly differ in that the speech section includes more tones. Therefore, it may be determined, according to a tone parameter of the audio signal, whether the current frame of the audio signal is in a speech section.

The tone parameter in this embodiment may be any parameter that can represent a tone characteristic of the audio signal. For example, the tone parameter is a tone quantity. Using the current frame as an example, the step of obtaining a tone parameter is first, obtaining a power density spectrum of the current frame according to an FFT transformation result; second, determining a partial maximum point in the power density spectrum of the current frame; and finally, analyzing several power density spectrum coefficients centered around the partial maximum point, and further determining whether the partial maximum point is a true tone component.

How to select several power density spectrum coefficients centered around the partial maximum point for analysis is relatively flexible, and may be set according to a requirement of an algorithm. For example, the following manner may be used for implementation: It is assumed that a partial maximum point of a power density spectrum is $p_f$, where $0<f<(F/2-1)$. If the partial maximum point $P_f$ satisfies the following condition $P_f-P_{(f\pm i)}\geq 7$ dB, where i=2, 3, . . . , 10, that is, when it is determined that there is a relatively large difference between a value of the partial maximum point and a value of another neighboring point, where in this embodiment, the difference is 7 dB, it indicates that the partial maximum point is a true tone component. A quantity of tone components is counted, and an obtained tone quantity of the current frame is used as the tone parameter.

Step S203: Determine, according to the tone parameter of the current frame and the tone parameter of each of the frames in the preset neighboring domain range of the current frame, whether the current frame is in a speech section or a non-speech section.

After the tone parameter of the current frame and the tone parameter of each of the frames in the preset neighboring domain range of the current frame are obtained, the tone parameter of each frame may be analyzed, so as to determine whether the current frame is in a speech section or a non-speech section.

A difference between a speech signal and a non-speech signal mainly lies in that tone parameter distribution of the speech signal complies with a particular rule. For example, in frames within a particular range, there are a relatively large quantity of frames having a relatively large quantity of tone components; or in frames within a particular range, an average value of tone component quantities of the frames is relatively high; or in frames within a particular range, there are a relatively large quantity of frames whose tone component quantities exceed a particular threshold. Therefore, the tone parameter of the current frame and the tone parameter of each of the frames in the preset neighboring domain range of the current frame may be analyzed, and if a corresponding characteristic of the speech signal is satisfied, it may be determined that the current frame is in a speech section.

Step S204: Determine that the current frame is speech-grade noise if the current frame is in a speech section and a quantity of frequency-domain energy distribution parameters falling within a preset speech-grade noise frequency-domain energy distribution parameter interval in all the frequency-domain energy distribution parameters is greater than or equal to a first threshold.

For an audio signal, frequency-domain energy of a normal audio signal frame has some constant characteristics, and a particular deviation exists between a frequency-domain energy distribution parameter of a noise signal frame and that of the normal audio signal frame. Therefore, after it is determined that the current frame is in a speech section, and the frequency-domain energy distribution parameter of the current frame and the frequency-domain energy distribution parameters of the frames in the preset neighboring domain range of the current frame are obtained, whether the current frame is speech-grade noise may be determined by analyzing whether the frequency-domain energy distribution parameter of the current frame and the frequency-domain energy distribution parameters of the frames in the preset neighboring domain range of the current frame present a characteristic of a noise signal. In this way, noise detection of the audio signal is completed.

Because frequency-domain energy distribution parameters of a normal audio signal in a speech section have different characteristics, after it is determined that the current frame is in a speech section, it is further determined whether a quantity of frequency-domain energy distribution parameters falling within a preset speech-grade noise frequency-domain energy distribution parameter interval in the frequency-domain energy distribution parameter of the current frame and the frequency-domain energy distribution parameter of each frame in the preset neighboring domain range of the current frame is greater than or equal to a first threshold.

That is, the current frame and each frame in the preset neighboring domain range of the current frame are used as a frame set; it is determined whether a frequency-domain energy distribution parameter of each frame in the frame set falls within the preset speech-grade noise frequency-domain energy distribution parameter interval; and a quantity of frequency-domain energy distribution parameters falling within the preset speech-grade noise frequency-domain energy distribution parameter interval is counted, and it is determined whether the quantity is greater than or equal to the first threshold. If the quantity is greater than or equal to the first threshold, it is determined that the current frame is speech-grade noise.

According to the noise detection method provided in this embodiment, a frequency-domain energy parameter and a tone parameter of a current frame and a frequency-domain energy distribution parameter and a tone parameter of each of frames in a preset neighboring domain range of the current frame are obtained; it is determined, according to the tone parameters, whether the current frame is in a speech section; and it is determined, according to the frequency-domain energy distribution parameters, whether the current frame is speech-grade noise. Therefore, a method for detecting noise of an audio signal according to a frequency-domain energy variation of the audio signal is provided, so that noise detection accuracy of an audio signal can be improved.

The following provides a specific method for determining whether the current frame is in a speech section according to the tone parameter of the current frame and the tone parameter of each of the frames in the preset neighboring domain range of the current frame. The specific method is: obtaining a largest tone quantity value, where the largest tone quantity value is a tone quantity of a frame whose tone quantity is the largest among the current frame and the frames in the preset neighboring domain range of the current frame; and if the largest tone quantity value is greater than or equal to a preset speech threshold, determining that the current frame is in a speech section, or if the largest tone quantity value is smaller than a preset speech threshold, determining that the current frame is in a non-speech section.

It can be learned according to a characteristic of an audio signal that a speech signal generally includes a section of continuous frames with tones. The speech signal includes an unvoiced sound and a voiced sound, the unvoiced sound does not have a tone, and the voiced sound has a relatively large quantity of tones. Therefore, if a frame or limited frames in an audio signal have a relatively small quantity of tones, the frame may not be a frame in a speech section; likewise, if a frame or limited frames in an audio signal have a relatively large quantity of tones, the frame may be a frame in a speech section. Therefore, similar to the analysis of the frequency-domain energy of the audio signal, when it is determined whether the current frame is in a speech section, both a tone quantity of the current frame and a tone quantity of each of the frames in the preset neighboring domain range of the current frame are obtained and analyzed. Moreover, only a tone quantity of the frame whose tone quantity is the largest among the current frame and the frames in the preset neighboring domain range of the current frame needs to be obtained. The tone quantity is used as a largest tone quantity value of the current frame, and it is determined whether the largest tone quantity value of the current frame satisfies a characteristic of the speech signal.

The obtaining a tone quantity of a frame whose tone quantity is the largest among the current frame and the frames in the preset neighboring domain range of the current frame, that is, the largest tone quantity value, is based on a frequency-domain characteristic of the audio signal. First, the tone quantity of the current frame is obtained based on the frequency-domain representation form of the audio signal, and is represented by num_tonal_flag. Then, a largest tone quantity value of each of the frames in the neighboring domain range of the current frame is obtained. The neighboring domain range of the current frame may be preset. For example, the neighboring domain range of the current frame is set to 20 frames. When the largest tone quantity value of the current frame and the frames in the neighboring domain range of the current frame is obtained, a tone quantity of each frame in a range of previous 10 frames of the current frame and subsequent 10 frames of the current frame is detected, and a largest tone quantity value within the range is used as the largest tone quantity value of the current frame, which is represented by avg_num_tonal_flag. It is determined, according to the largest tone quantity value of the current frame, whether the current frame is in a speech section, and if avg_num_tonal_flag≥N1, it is determined that the current frame is in a speech section, or if avg_num_tonal_flag<N1, it is determined that the current frame is in a non-speech section, where N1 is a tone quantity threshold of the speech section.

Figure 3A:
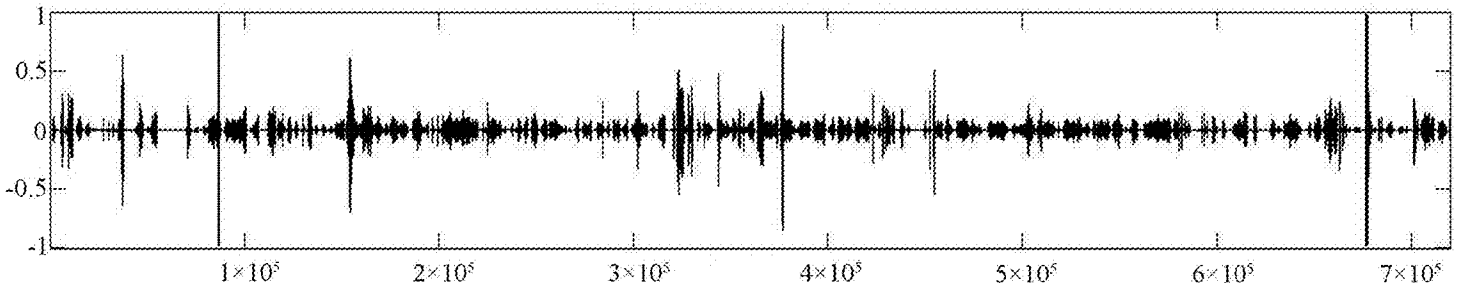
FIG. 3A, FIG. 3B, and FIG. 3C are schematic diagrams of a tone variation of an audio signal according to an embodiment.
Figure 3B:
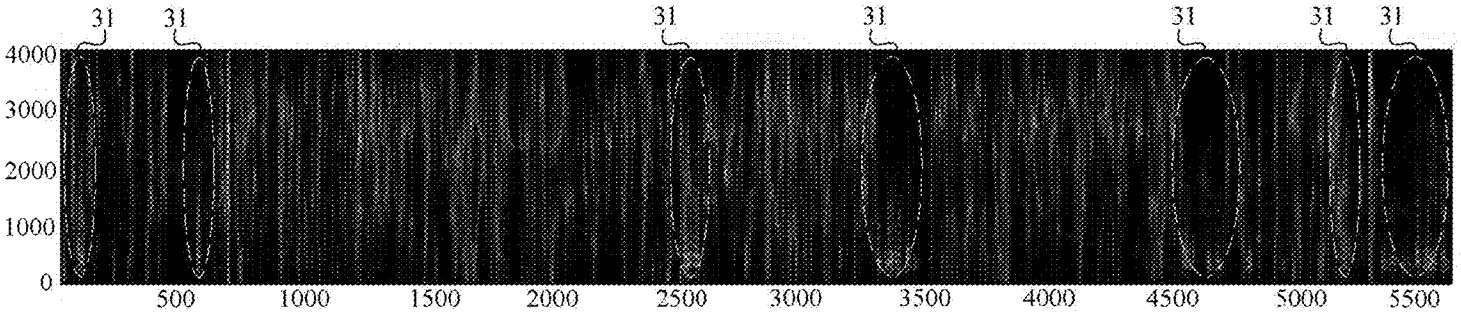
Figure 3C:
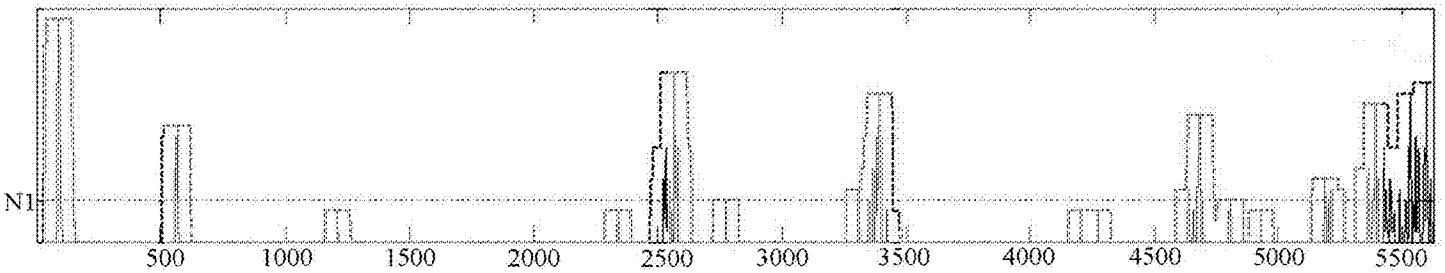

FIG. 3A to FIG. 3C are schematic diagrams of a tone variation of an audio signal according to an embodiment. FIG. 3A shows a time-domain waveform of an audio signal, where a horizontal axis is a sample point, and a vertical axis is a normalized amplitude. It is difficult to distinguish a speech section from a non-speech section in FIG. 3A. FIG. 3B is a spectrogram of the audio signal shown in FIG. 3A, and is obtained after FFT transformation is performed on the audio signal shown in FIG. 3A, where a horizontal axis is a frame quantity, which corresponds to the sample point in FIG. 3A in a time domain, and a vertical axis is frequency, which is in units of hertz (Hz). It can be detected that frames in a dashed circle of FIG. 3B have a relatively large quantity of tone components. Therefore, a range 31 in the dashed circle is a speech section. FIG. 3C is a tone quantity variation curve of the audio signal shown in FIG. 3A, where a horizontal axis is a frame quantity, and a vertical axis is a tone quantity value. In FIG. 3C, a solid curve represents a tone quantity num_tonal_flag of each frame, a dashed curve represents a largest tone quantity value avg_num_tonal_flag of each frame and frames in a preset neighboring domain range of the frame, and N1 in a vertical axis represents a speech section threshold. The speech section and the non-speech section of the audio signal can be distinguished in FIG. 3C.

Figure 4:
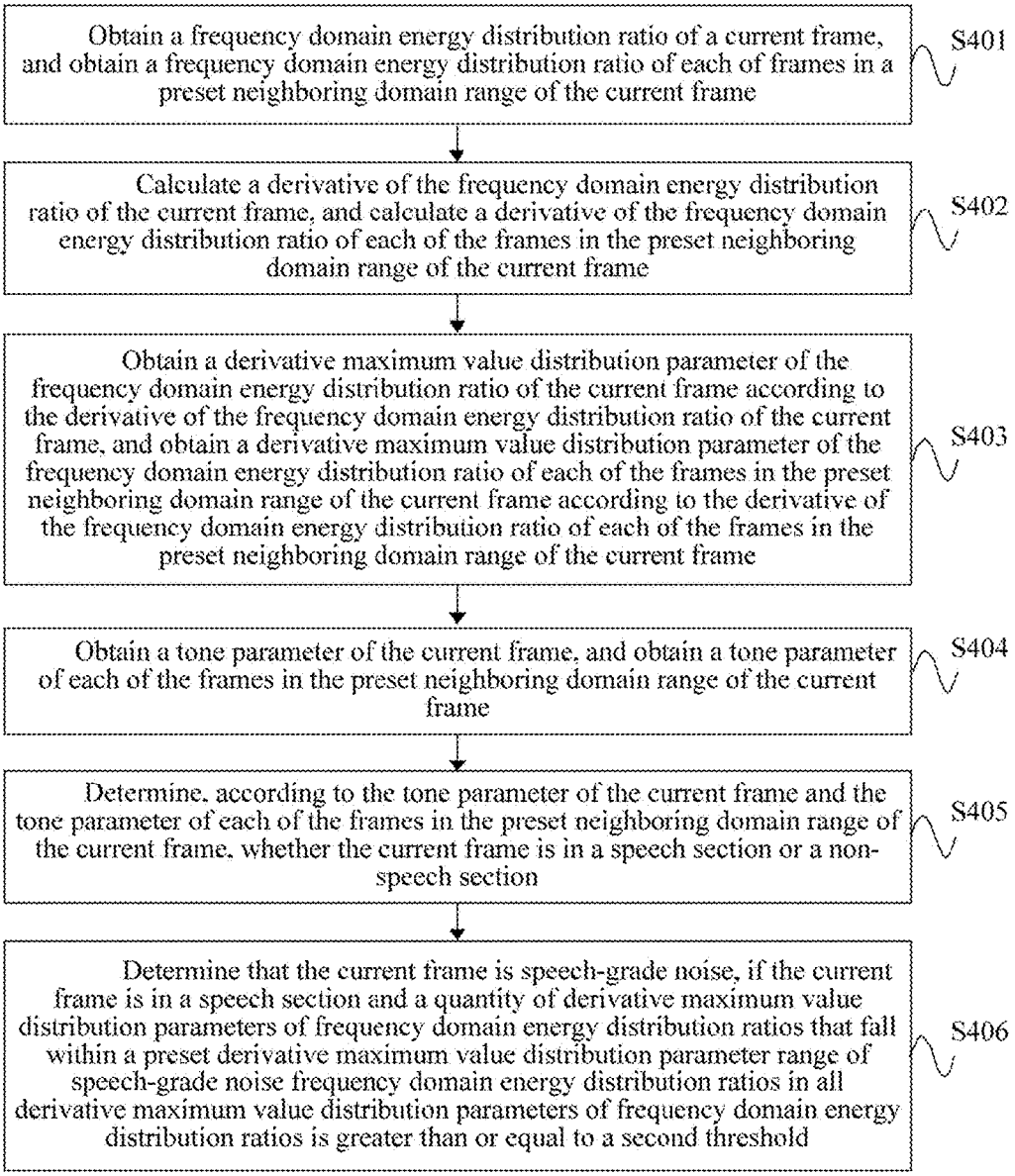
FIG. 4 is a flowchart of Embodiment 2 of a noise detection method according to an embodiment of the present disclosure.

FIG. 4 is a flowchart of Embodiment 2 of a noise detection method according to an embodiment of the present disclosure. As shown in FIG. 4, the method in this embodiment includes the following steps.

Step S401: Obtain a frequency-domain energy distribution ratio of the current frame, and obtain a frequency-domain energy distribution ratio of each of frames in a preset neighboring domain range of the current frame.

Based on the embodiment shown in FIG. 2, this embodiment provides a specific method for obtaining a frequency-domain energy distribution parameter of a current frame and a frequency-domain energy distribution parameter of each of frames in a preset neighboring domain range of the current frame, and detecting speech-grade noise. The frequency-domain energy distribution parameter is a derivative maximum value distribution parameter of a frequency-domain energy distribution ratio.

First, the frequency-domain energy distribution ratio of the current frame is obtained, where a frequency-domain energy distribution ratio of an audio signal is used to represent an energy distribution characteristic of the current frame in a frequency domain.

Assuming that the current frame of the audio signal is the $k^{th}$ frame, a general formula of a frequency-domain energy distribution curve of the current frame is as follows:

$$\text{ratio_energy}_k(f) = \frac{\sum_{i=0}^{f}(\text{Re_fft}^2(i) + \text{Im_fft}^2(i))}{\sum_{i=0}^{(F_{lim}-1)}(\text{Re_fft}^2(i) + \text{Im_fft}^2(i))} \times 100\%, \quad f \in [0, (F_{lim}-1)] \tag{1}$$

where $\text{ratio_energy}_k(f)$ represents a frequency-domain energy distribution ratio of the $k^{th}$ frame, Re_fft(i) represents a real part of FFT transformation of the $k^{th}$ frame, and Im_fft(i) represents an imaginary part of the FFT transformation of the $k^{th}$ frame. In the foregoing formula, a denominator represents a sum of energy of the $k^{th}$ frame in a frequency domain corresponding to $i \in [0,(F_{lim}-1)]$, and a numerator represents a sum of energy of the $k^{th}$ frame in a frequency range corresponding to $i \in [0, f]$.

A value of $F_{lim}$ may be set according to experience, for example, may be set as $F_{lim}=F/2$, where F is an FFT transformation magnitude. Then, the formula (1) is converted to a formula (2):

$$\text{ratio_energy}_k(f) = \frac{\sum_{i=0}^{f}(\text{Re_fft}^2(i) + \text{Im_fft}^2(i))}{\sum_{i=0}^{(F/2-1)}(\text{Re_fft}^2(i) + \text{Im_fft}^2(i))} \times 100\%, \quad f \in [0, (F/2-1)] \tag{2}$$

where in the formula (2), the denominator represents total energy of the $k^{th}$ frame, and the numerator represents the sum of the energy of the $k^{th}$ frame in the frequency range corresponding to $i \in [0, f]$.

The frequency-domain energy distribution ratio of each of the frames in the preset neighboring domain range of the current frame is obtained according to the foregoing method. The neighboring domain range of the current frame may be preset. For example, the neighboring domain range of the current frame is set to 20 frames. When the current frame is the $k^{th}$ frame, the neighboring domain range of the current frame is [k−10, k+10].

Step S402: Calculate a derivative of the frequency-domain energy distribution ratio of the current frame, and calculate a derivative of the frequency-domain energy distribution ratio of each of the frames in the preset neighboring domain range of the current frame.

To further highlight energy distribution characteristics of the current frame and each of the frames in the preset neighboring domain range of the current frame in a frequency domain, next, the derivative of the frequency-domain energy distribution ratio of the current frame and the derivative of the frequency-domain energy distribution ratio of each of the frames in the preset neighboring domain range of the current frame are calculated. There may be many methods for calculating a derivative of a frequency-domain energy distribution ratio, and a Lagrange (Lagrange) numerical differentiation method is used herein as an example for description.

Assuming that the current frame of the audio signal is the $k^{th}$ frame, a general formula for calculating the derivative of the frequency-domain energy distribution ratio of the current frame using the Lagrange numerical differentiation method is as follows:

$$\text{ratio_energy}'_k(f) = \left(\sum_{n=f-\frac{N-1}{2}}^{f+\frac{N-1}{2}}\left(\prod_{\substack{i=f-\frac{N-1}{2}\\ i\neq n}}^{f+\frac{N-1}{2}}\frac{f-i}{n-i}\right) * \text{ratio_energy}_k(n)\right)\Bigg)' \tag{3}$$

where $\text{ratio_energy}'_k(f)$ represents a derivative of a frequency-domain energy distribution ratio of the $k^{th}$ frame, $\text{ratio_energy}_k(n)$ represents an energy distribution ratio of the $k^{th}$ frame, N represents a numerical differentiation order in the formula (3), and $$f \in \left[\frac{N-1}{2}, \left(F_{lim} - \frac{N-1}{2}\right)\right].$$

A value of N may be set according to experience, for example, may be set as N=7. The formula (3) is converted to the following formula:

$$\text{ratio_energy}'_k(f) = -\frac{1}{60}\text{ratio_energy}_k(f-3) + \frac{9}{60}\text{ratio_energy}_k(f-2) - \frac{45}{60}\text{ratio_energy}_k(f-1) + \frac{45}{60}\text{ratio_energy}_k(f+1) - \frac{9}{60}\text{ratio_energy}_k(f+2) + \frac{1}{60}\text{ratio_energy}_k(f+3)$$

where $f \in [3, (F/2-4)]$, and when $f \in [0, 2]$ or $F \in [(F/2-3), (F/2-1)]$, $\text{ratio_energy}'_k(f)$ is set to 0.

Likewise, the derivative of the frequency-domain energy distribution ratio of each of the frames in the preset neighboring domain range of the current frame is obtained according to the foregoing method.

Step S403: Obtain a derivative maximum value distribution parameter of the frequency-domain energy distribution ratio of the current frame according to the derivative of the frequency-domain energy distribution ratio of the current frame, and obtain a derivative maximum value distribution parameter of the frequency-domain energy distribution ratio of each of the frames in the preset neighboring domain range of the current frame according to the derivative of the frequency-domain energy distribution ratio of each of the frames in the preset neighboring domain range of the current frame.

Finally, the derivative maximum value distribution parameter of the frequency-domain energy distribution ratio of the current frame is obtained according to the derivative of the frequency-domain energy distribution ratio of the current frame, and the derivative maximum value distribution parameter of the frequency-domain energy distribution ratio of each of the frames in the preset neighboring domain range of the current frame is obtained according to the derivative of the frequency-domain energy distribution ratio of each of the frames in the preset neighboring domain range of the current frame. A derivative maximum value distribution parameter of a frequency-domain energy distribution ratio is represented by a parameter pos_max_L7_n, where n represents the $n^{th}$ largest value in derivatives of frequency-domain energy distribution ratios, and $pos_max_L7__n$ represents a position of a spectral line in which the $n^{th}$ largest value in the derivatives of the frequency-domain energy distribution ratios is located.

Step S404: Obtain a tone parameter of the current frame, and obtain a tone parameter of each of the frames in the preset neighboring domain range of the current frame.

This step is the same as step S202.

Step S405: Determine, according to the tone parameter of the current frame and the tone parameter of each of the frames in the preset neighboring domain range of the current frame, whether the current frame is in a speech section or a non-speech section.

This step is the same as step S203.

Step S406: Determine that the current frame is speech-grade noise if the current frame is in a speech section and a quantity of derivative maximum value distribution parameters of frequency-domain energy distribution ratios that fall within a preset derivative maximum value distribution parameter interval of speech-grade noise frequency-domain energy distribution ratios in all derivative maximum value distribution parameters of the frequency-domain energy distribution ratios is greater than or equal to a second threshold.

A frequency-domain energy variation rule of the current frame and each of the frames in the preset neighboring domain range of the current frame may be visually obtained according to the derivative maximum value distribution parameters of the frequency-domain energy distribution ratios, so that whether the current frame is noise may be determined according to the derivative maximum value distribution parameters of the frequency-domain energy distribution ratios of the current frame and each of the frames in the preset neighboring domain range of the current frame. A noise interval of derivative maximum value distribution parameters of frequency-domain energy distribution ratios may be preset. If it is determined that the largest tone quantity value is greater than or equal to the preset speech threshold, that is, the current frame is in a speech section, a quantity of frames whose derivative maximum value distribution parameters of frequency-domain energy distribution ratios fall within the preset noise interval of the derivative maximum value distribution parameters of the frequency-domain energy distribution ratios in the current frame and the frames in the preset neighboring domain range of the current frame is counted, and it is determined whether the quantity is greater than or equal to the preset second threshold. It is determined that the current frame is speech-grade noise only when the quantity is greater than or equal to the second threshold. That is, if the current frame is in a speech section, it is determined that the current frame is speech-grade noise only when it is determined that a large quantity of frames in the current frame and several neighboring frames have sudden frequency-domain energy variations.

In this step, the current frame and the frames in the preset neighboring domain range of the current frame are used as a frame set, and a quantity of speech frames that are in the frame set corresponding to the current frame and that satisfy a condition pos_max_L7_1≤F2 and a quantity of speech frames that are in the frame set corresponding to the current frame and that satisfy a condition 0<pos_max_L7_1<F1 are separately extracted and are respectively represented by num_max_pos_lf and num_min_pos_lf, where F1 and F2 are respectively a lower limit and an upper limit of a derivative maximum value distribution parameter interval of frequency-domain energy distribution ratios of speech frames. Further, it is determined whether the current frame satisfies both conditions: num_max_pos_lf>N2 and num_min_pos_lf≤N3, that is, it is determined whether a quantity of frames whose derivative maximum value distribution parameters of frequency-domain energy distribution ratios fall within the preset derivative maximum value distribution parameter interval of the speech-grade noise frequency-domain energy distribution ratios exceeds the second threshold, where N2 and N3 form a preset derivative maximum value distribution parameter threshold interval of the speech-grade noise frequency-domain energy distribution ratios. That the threshold interval is satisfied is equivalent to that the quantity is greater than or equal to the second threshold.

Figure 5A:
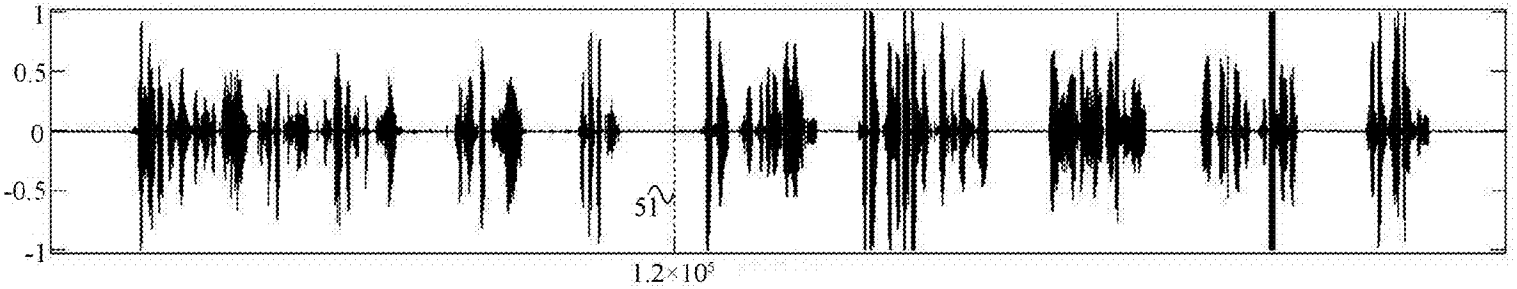
FIG. 5A, FIG. 5B, and FIG. 5C are schematic diagrams of a noise detection according to an embodiment.
Figure 5B:
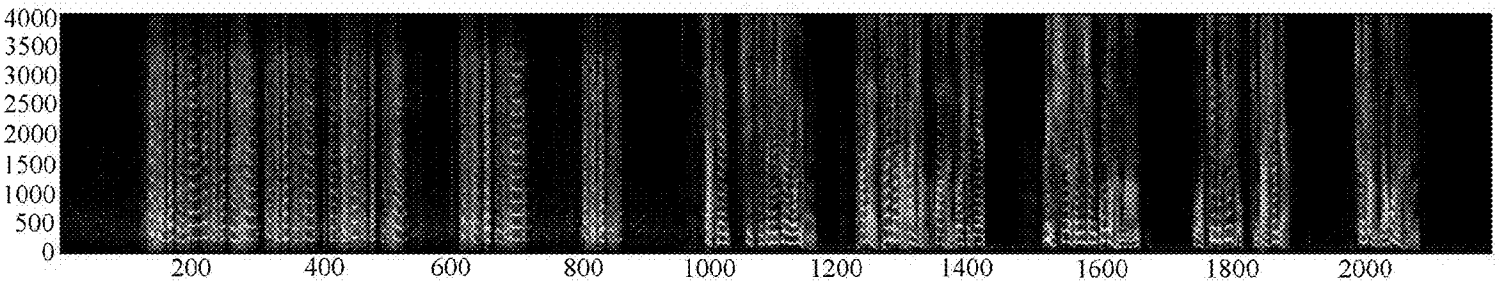
Figure 5C:
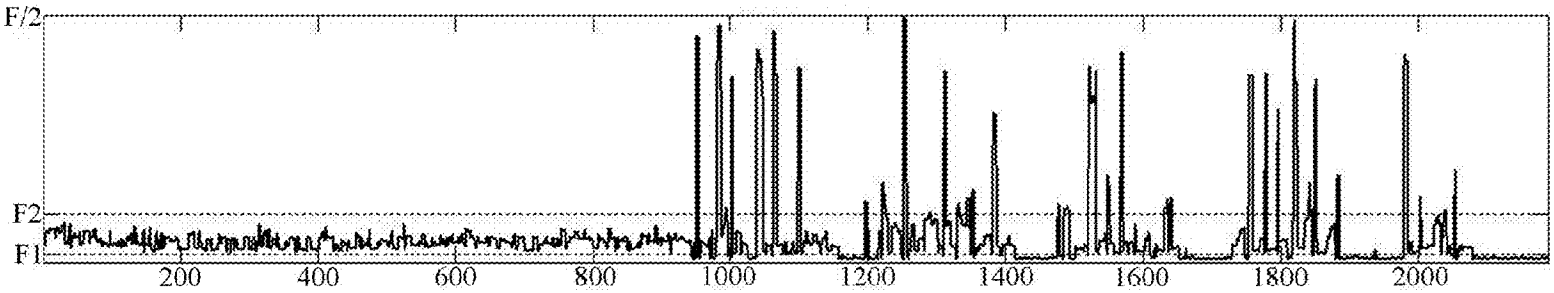

As shown in FIG. 5A to FIG. 5C, FIG. 5A to FIG. 5C are schematic diagrams of a noise detection according to an embodiment. FIG. 5A shows a time-domain waveform of an audio signal, where a horizontal axis is a sample point, and a vertical axis is a normalized amplitude. Bounded by a dotted line 51, speech-grade noise is on the left of the dotted line 51, and a normal speech is on the right of the dotted line 51. It is difficult to distinguish the speech-grade noise from the normal speech in FIG. 5A. FIG. 5B is a spectrogram of the audio signal shown in FIG. 5A, and is obtained after FFT transformation is performed on the audio signal shown in FIG. 5A, where a horizontal axis is a frame quantity, which corresponds to the sample point in FIG. 5A in a time domain, and a vertical axis is frequency, which is in units of Hz. It can be learned from FIG. 5B that the entire audio signal has a relatively large quantity of tones. FIG. 5C is a distribution curve of largest derivative values of frequency-domain energy distribution ratios of the audio signal shown in FIG. 5A, where a horizontal axis is a frame quantity, a vertical axis is a value of pos_max_L7_1, and F1 and F2 on the vertical axis are respectively a lower limit and an upper limit of a derivative maximum value distribution parameter interval of frequency-domain energy distribution ratios of speech frames. It can be learned from FIG. 5C that, bounded by the dotted line 51, values of pos_max_L7_1 in an area on the left of the dotted line 51 are basically limited between F1 and F2, but values of pos_max_L7_1 in an area on the right of the dotted line 51 are not limited.

Further, FIG. 4 shows a specific method for: when the frequency-domain energy distribution parameter is a derivative maximum value distribution parameter of a frequency-domain energy distribution ratio, determining, according to derivative maximum value distribution parameters of frequency-domain energy distribution ratios, whether the current frame is speech-grade noise. In a specific implementation manner of the embodiment shown in FIG. 2, the frequency-domain energy distribution parameter includes a frequency-domain energy distribution ratio and a derivative maximum value distribution parameter of the frequency-domain energy distribution ratio, that is, after it is determined that the current frame is in a speech section, whether the current frame is speech-grade noise is determined according to both derivative maximum value distribution parameters of frequency-domain energy distribution ratios and the frequency-domain energy distribution ratios.

A value range of pos_max_L7_1 of most normal speeches is similar to that of the normal speech shown in FIG. 5C. Therefore, in most cases, speech-grade noise in an audio signal can be detected through determining in the embodiment shown in FIG. 4. However, a value range of pos_max_L7_1 of a few normal speeches is also basically between F1 and F2, and for these normal speeches, if determining is performed according only to the method provided in the embodiment shown in FIG. 4, a normal speech may be mistaken for speech-grade noise.

Therefore, in this implementation manner, the determining that the current frame is speech-grade noise if the current frame is in a speech section and a quantity of frequency-domain energy distribution parameters falling within a preset speech-grade noise frequency-domain energy distribution parameter interval in all the frequency-domain energy distribution parameters is greater than or equal to a first threshold includes: determining that the current frame is speech-grade noise if the current frame is in a speech section, a quantity of derivative maximum value distribution parameters of frequency-domain energy distribution ratios that fall within a preset derivative maximum value distribution parameter interval of speech-grade noise frequency-domain energy distribution ratios in all derivative maximum value distribution parameters of the frequency-domain energy distribution ratios is greater than or equal to the second threshold, and a quantity of frequency-domain energy distribution ratios falling within a preset speech-grade noise frequency-domain energy distribution ratio interval in all the frequency-domain energy distribution ratios is greater than or equal to a third threshold.

In this implementation manner, first, processing is performed according to step S401 to step S405 in the embodiment shown in FIG. 4. Then, when step S406 is performed, after it is determined that a quantity of derivative maximum value distribution parameters of frequency-domain energy distribution ratios that fall within a preset derivative maximum value distribution parameter interval of speech-grade noise frequency-domain energy distribution ratios in all derivative maximum value distribution parameters of the frequency-domain energy distribution ratios is greater than or equal to a second threshold, it is not directly determined that the current frame is speech-grade noise, but it is further determined whether a quantity of frequency-domain energy distribution ratios falling within a preset speech-grade noise frequency-domain energy distribution ratio interval in all the frequency-domain energy distribution ratios is greater than or equal to a third threshold. It can be determined that the current frame is speech-grade noise only when the foregoing two conditions are both satisfied.

That is, based on step S406, the current frame and each of the frames in the preset neighboring domain range of the current frame are still used as a frame set, and a quantity of speech frames that are in the frame set corresponding to the current frame and that satisfy a condition $ratio_energy_k(lf)>R2$ and a quantity of speech frames that are in the frame set corresponding to the current frame and that satisfy a condition $ratio_energy_k(lf)\leq R1$ are separately extracted and are respectively represented by num_max_ratio_energy_lf and num_min_ratio_energy_lf, where R1 and R2 are respectively a lower limit and an upper limit of the speech-grade noise frequency-domain energy distribution ratio interval. $ratio_energy_k(lf)$ is used to represent frequency-domain energy distribution characteristics of the current frame and the frames in the preset neighboring domain range of the current frame in a relatively low frequency interval, and in this embodiment, it is set that lf=F/2. Further, it is determined whether the current frame satisfies both conditions num_max_ratio_energy_lf<N4 and num_min_ratio_energy_lf≤N5, that is, it is determined whether a quantity of frames whose frequency-domain energy distribution ratios fall within the preset speech-grade noise frequency-domain energy distribution ratio interval is greater than or equal to the third threshold, where N4 and N5 form a preset frequency-domain energy distribution ratio threshold interval of a speech-grade noise interval. That the threshold interval is satisfied is equivalent to that the quantity is greater than or equal to the third threshold.

Figure 6A:
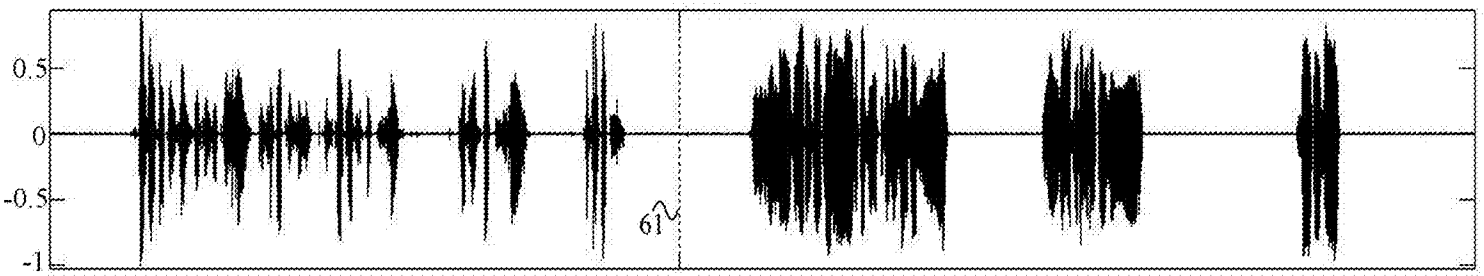
FIG. 6A, FIG. 6B, and FIG. 6C are schematic diagrams of another noise detection according to an embodiment.
Figure 6B:
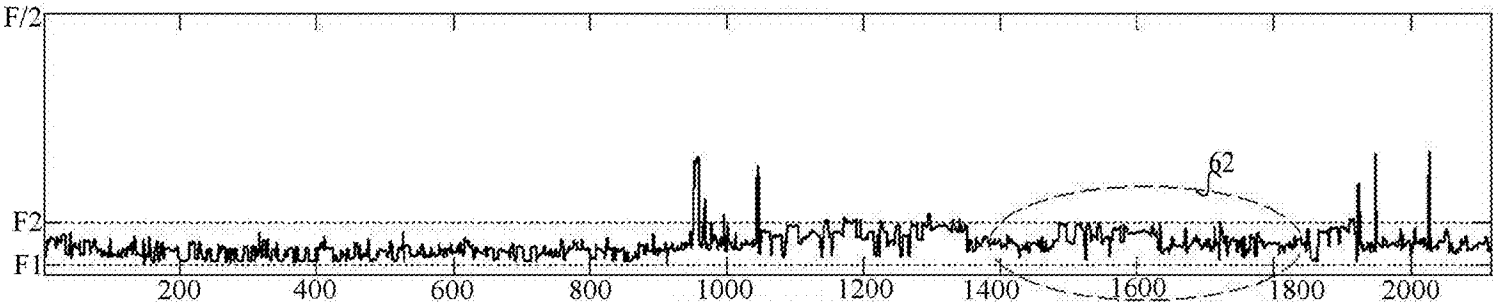
Figure 6C:
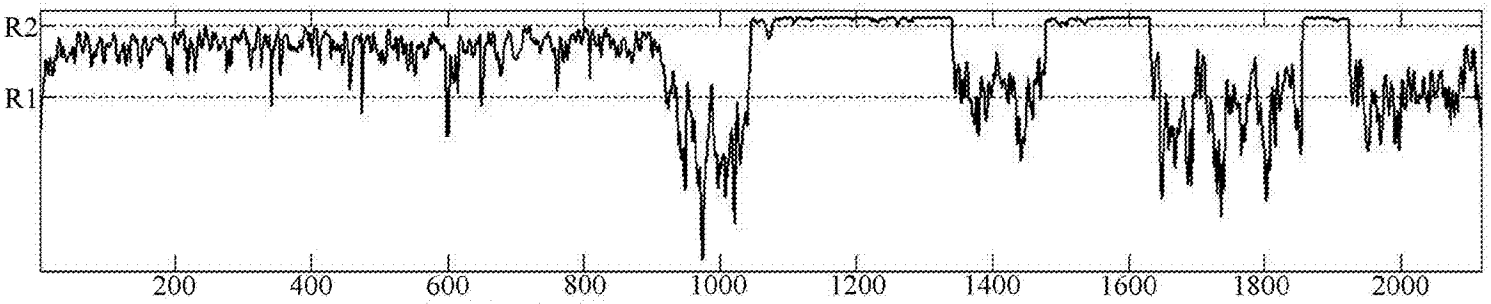

As shown in FIG. 6A to FIG. 6C, FIG. 6A to FIG. 6C are schematic diagrams of another noise detection according to an embodiment. FIG. 6A shows a time-domain waveform of an audio signal, where a horizontal axis is a sample point, and a vertical axis is a normalized amplitude. Bounded by a dotted line 61, speech-grade noise is on the left of the dotted line 61, and a normal speech is on the right of the dotted line 61. It is difficult to distinguish the speech-grade noise from the normal speech in FIG. 6A. FIG. 6B is a distribution curve of largest derivative values of frequency-domain energy distribution ratios of the audio signal shown in FIG. 6A, where a horizontal axis is a frame quantity, a vertical axis is a value of pos_max_L7_1, and F1 and F2 on the vertical axis are respectively a lower limit and an upper limit of a derivative maximum value distribution parameter interval of frequency-domain energy distribution ratios of speech frames. It can be learned from FIG. 6B that a value range of pos_max_L7_1 of normal speech frames in a range 62 also basically falls within an interval range between F1 and F2. Therefore, if determining is performed only using pos_max_L7_1, these normal speech frames may be mistaken. FIG. 6C is a distribution curve of the frequency-domain energy distribution ratios of the audio signal shown in FIG. 6A, where a horizontal axis is a frame quantity, a vertical axis is a value of $ratio_energy_k(lf)$, and R1 and R2 on the vertical axis are respectively a lower limit and an upper limit of a frequency-domain energy distribution ratio interval of speech frames. It can be learned from FIG. 6C that values of the speech-grade noise on the left of the dotted line 61 are basically limited between R1 and R2, but a value range of normal speech frames, including normal speech frames in a range 62, on the right of the dotted line 61 is not limited.

As described above, if the quantity of frames whose derivative maximum value distribution parameters of frequency-domain energy distribution ratios fall within the preset derivative maximum value distribution parameter interval of speech-grade noise frequency-domain energy distribution ratios in the current frame and the frames in the preset neighboring domain range of the current frame exceeds the second threshold, and the quantity of frames whose frequency-domain energy distribution ratios fall within the preset speech-grade noise frequency-domain energy distribution ratio interval in the current frame and the frames in the preset neighboring domain range of the current frame exceeds the third threshold, it may be determined that the current frame is speech-grade noise.

According to the noise detection method provided in the embodiment shown in FIG. 2, a specific method for detecting speech-grade noise according to a frequency-domain energy distribution characteristic of an audio signal is provided. However, in addition to the speech-grade noise, the audio signal further includes non-speech-grade noise. Based on the embodiment shown in FIG. 2, the present disclosure further provides a non-speech-grade noise detection method.

Figure 7:
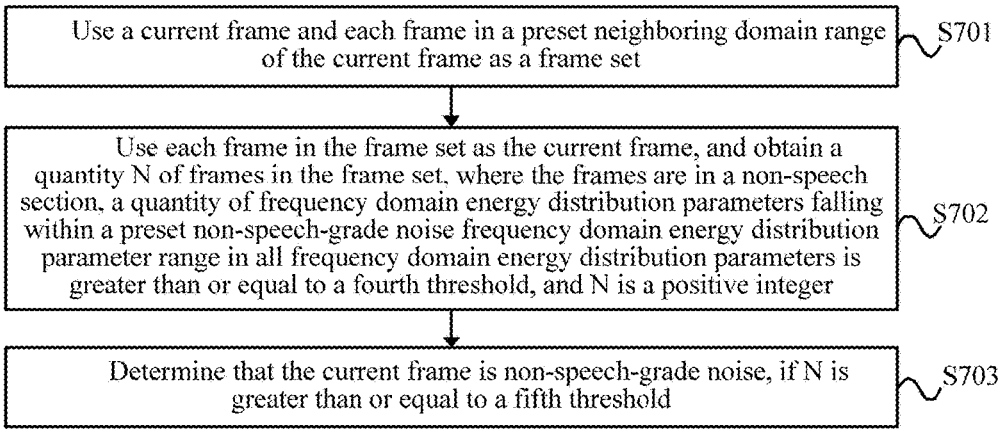
FIG. 7 is a flowchart of Embodiment 3 of a noise detection method according to an embodiment of the present disclosure.

FIG. 7 is a flowchart of Embodiment 3 of a noise detection method according to an embodiment of the present disclosure. As shown in FIG. 7, based on the embodiment shown in FIG. 2, the method in this embodiment further includes the following steps.

Step S701: Use the current frame and each frame in the preset neighboring domain range of the current frame as a frame set.

When it is determined whether the current frame is non-speech-grade noise, the current frame and each frame in the preset neighboring domain range of the current frame need to be used as a set, and determining is performed on all frames in the set.

Step S702: Use each frame in the frame set as the current frame, and obtain a quantity N of frames in the frame set, where the frames are in a non-speech section, a quantity of frequency-domain energy distribution parameters falling within a preset non-speech-grade noise frequency-domain energy distribution parameter interval in all the frequency-domain energy distribution parameters is greater than or equal to a fourth threshold, and N is a positive integer.

When determining is performed on the frame set in step S701, it needs to determine whether a quantity of frames in the frame set that satisfy both the following two conditions is greater than or equal to a fifth threshold, and if the quantity is greater than or equal to the fifth threshold, it is determined that the current frame is non-speech-grade noise. The foregoing two conditions are as follows: First, the frames are in a non-speech section; and second, the quantity of frequency-domain energy distribution parameters falling within the preset non-speech-grade noise frequency-domain energy distribution parameter interval is greater than or equal to the fourth threshold. During the determining, determining needs to be performed using each frame in the frame set as the current frame, and a quantity N of frames in the frame set that satisfy both the foregoing two conditions is counted.

Step S703: Determine that the current frame is non-speech-grade noise if N is greater than or equal to a fifth threshold.

If the quantity N is greater than or equal to the fifth threshold, it may be determined that the current frame is non-speech-grade noise.

Figure 8:
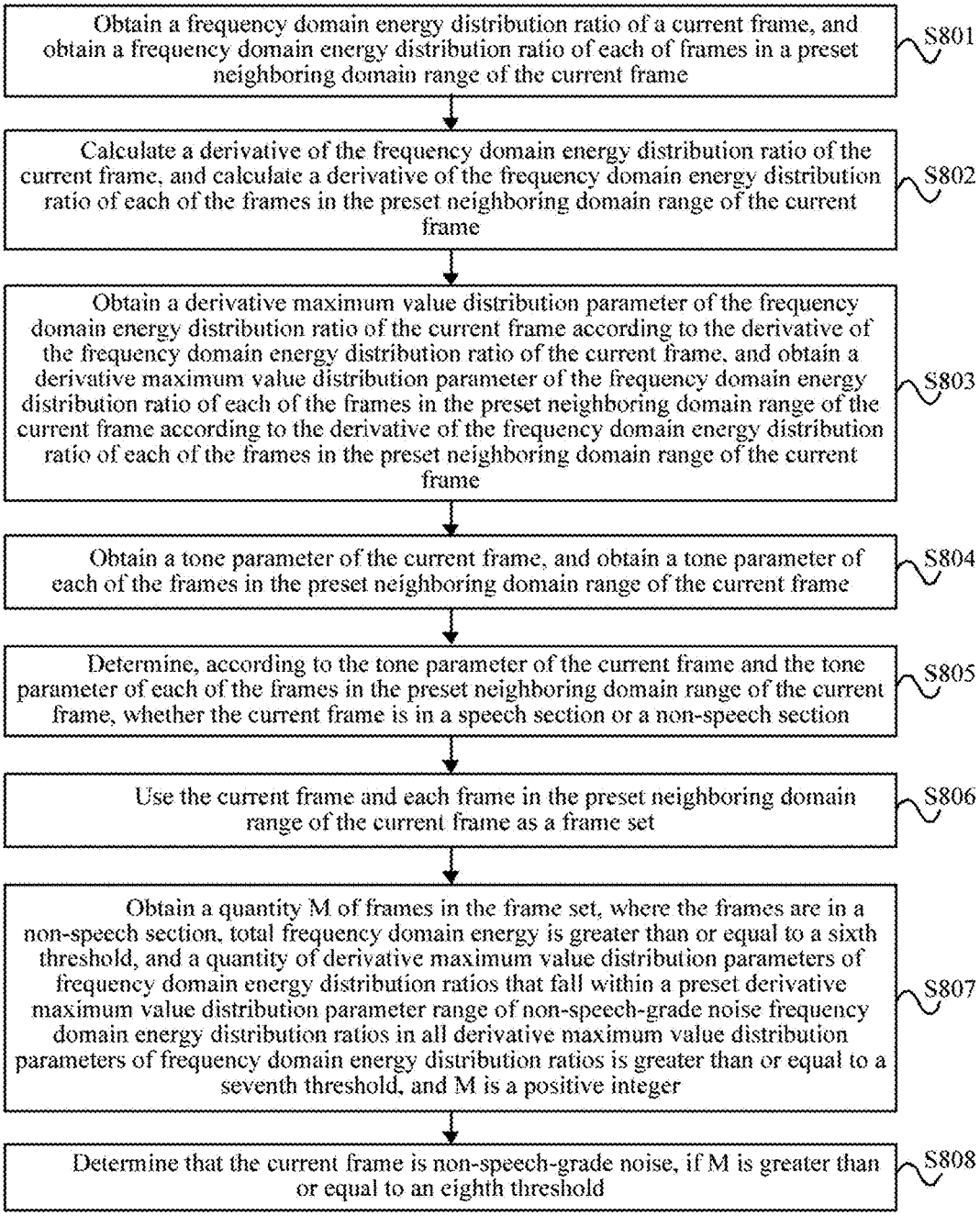
FIG. 8 is a flowchart of Embodiment 4 of a noise detection method according to an embodiment of the present disclosure.

FIG. 8 is a flowchart of Embodiment 4 of a noise detection method according to an embodiment of the present disclosure. As shown in FIG. 8, the method in this embodiment includes the following steps:

Step S801: Obtain a frequency-domain energy distribution ratio of the current frame, and obtain a frequency-domain energy distribution ratio of each of frames in a preset neighboring domain range of the current frame.

This embodiment is used to detect non-speech-grade noise in an audio signal. Based on the embodiment shown in FIG. 7, a specific method for obtaining a frequency-domain energy distribution parameter of a current frame and a frequency-domain energy distribution parameter of each of frames in a preset neighboring domain range of the current frame, and detecting non-speech-grade noise is provided. The frequency-domain energy distribution parameter is a derivative maximum value distribution parameter of a frequency-domain energy distribution ratio. This step is the same as step S401.

Step S802: Calculate a derivative of the frequency-domain energy distribution ratio of the current frame, and calculate a derivative of the frequency-domain energy distribution ratio of each of the frames in the preset neighboring domain range of the current frame.

This step is the same as step S402.

Step S803: Obtain a derivative maximum value distribution parameter of the frequency-domain energy distribution ratio of the current frame according to the derivative of the frequency-domain energy distribution ratio of the current frame, and obtain a derivative maximum value distribution parameter of the frequency-domain energy distribution ratio of each of the frames in the preset neighboring domain range of the current frame according to the derivative of the frequency-domain energy distribution ratio of each of the frames in the preset neighboring domain range of the current frame.

This step is the same as step S403.

Step S804: Obtain a tone parameter of the current frame, and obtain a tone parameter of each of the frames in the preset neighboring domain range of the current frame.

This step is the same as step S404.

Step S805: Determine, according to the tone parameter of the current frame and the tone parameter of each of the frames in the preset neighboring domain range of the current frame, whether the current frame is in a speech section or a non-speech section.

This step is the same as step S405.

Step S806: Use the current frame and each frame in the preset neighboring domain range of the current frame as a frame set.

This step is the same as step S701.

Step S807: Obtain a quantity M of frames in the frame set, where the frames are in a non-speech section, total frequency-domain energy is greater than or equal to a sixth threshold, a quantity of derivative maximum value distribution parameters of frequency-domain energy distribution ratios that fall within a preset derivative maximum value distribution parameter interval of non-speech-grade noise frequency-domain energy distribution ratios in all derivative maximum value distribution parameters of the frequency-domain energy distribution ratios is greater than or equal to a seventh threshold, and M is a positive integer.

When it is determined whether the current frame is non-speech-grade noise, the current frame and the frames in the preset neighboring domain range of the current frame need to be used as a set, and determining is performed on all frames in the set. It is determined whether a quantity of frames in the set that satisfy all of the following three conditions is greater than or equal to an eighth threshold, and if the quantity is greater than or equal to the eighth threshold, it is determined that the current frame is non-speech-grade noise. The three conditions are as follows: First, the frames are in a non-speech section; second, total frequency-domain energy is greater than or equal to a sixth threshold; and third, a quantity of derivative maximum value distribution parameters of frequency-domain energy distribution ratios that fall within a preset derivative maximum value distribution parameter interval of non-speech-grade noise frequency-domain energy distribution ratios is greater than or equal to a seventh threshold. During the determining, determining needs to be performed using each frame in the frame set as the current frame, and a quantity M of frames in the frame set that satisfy both the foregoing three conditions is counted. A specific determining method is described as follows:

The current frame and the frames in the preset neighboring domain range of the current frame are used as a frame set, and a quantity of non-speech frames that are in the frame set corresponding to the current frame and satisfy a condition pos_max_L7_1≥F3, and whose total frequency-domain energy is greater than the sixth threshold is extracted, and is represented by num_pos_hf, where F3 is a lower limit of the derivative maximum value distribution parameter interval of the non-speech-grade noise frequency-domain energy distribution ratios, and the sixth threshold is a lower energy limit of speech-grade noise. Further, it is determined whether the current frame further satisfies a condition num_pos_hf≥N6, where N6 is the seventh threshold.

Figure 9A:
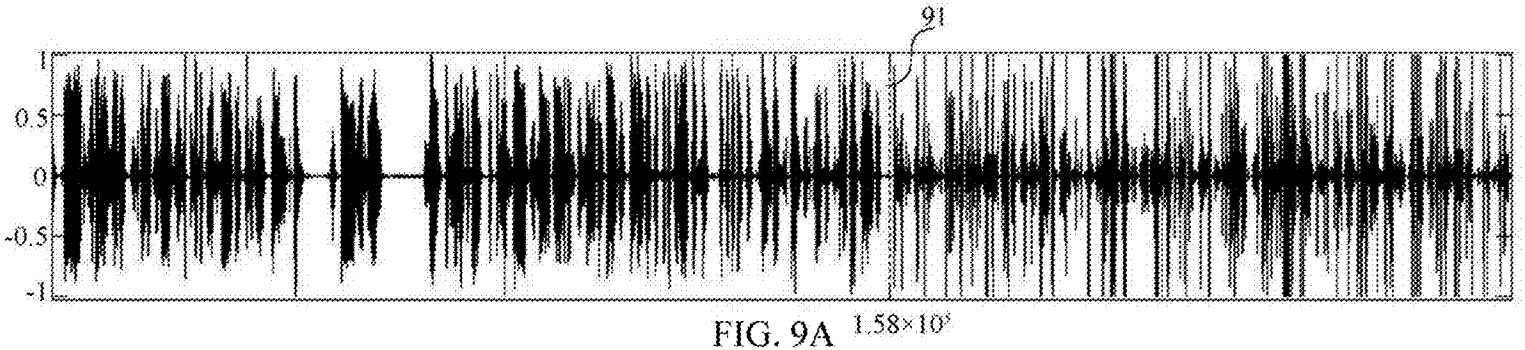
FIG. 9A, FIG. 9B, and FIG. 9C are schematic diagrams of still another noise detection according to an embodiment.
Figure 9B:
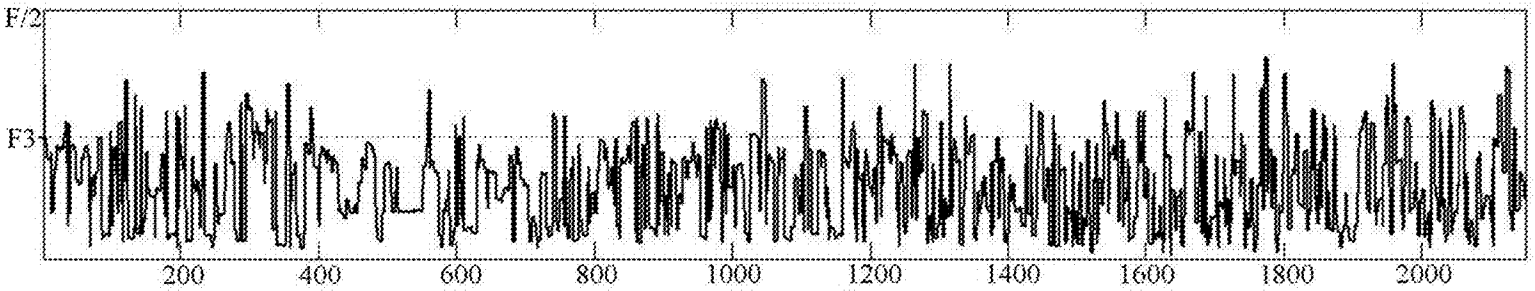
Figure 9C:
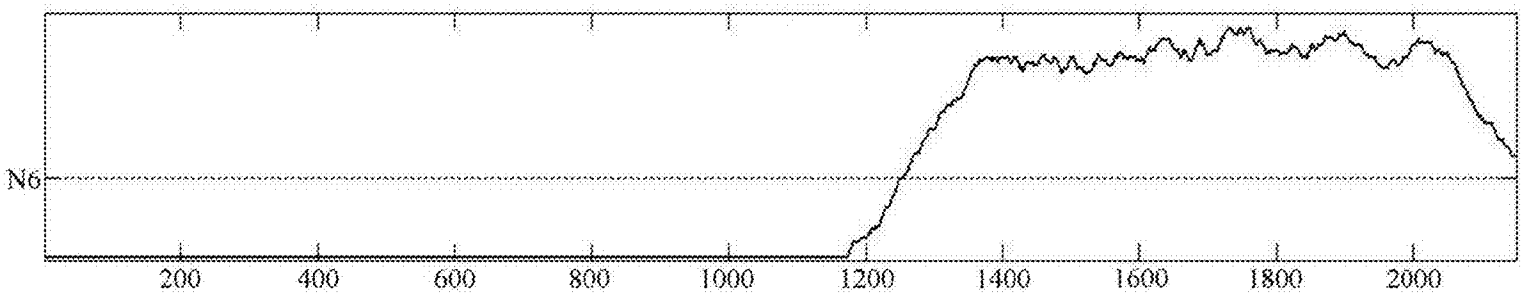

As shown in FIG. 9A to FIG. 9C, FIG. 9A to FIG. 9C are schematic diagrams of still another noise detection according to an embodiment. FIG. 9A shows a time-domain waveform of an audio signal, where a horizontal axis is a sample point, and a vertical axis is a normalized amplitude. Bounded by a dotted line 91, a normal speech is on the left of the dotted line 91, and non-speech-grade noise is on the right of the dotted line 91. It is difficult to distinguish the normal speech from the non-speech-grade noise in FIG. 9A. FIG. 9B is a distribution curve of largest derivative values of frequency-domain energy distribution ratios of the audio signal shown in FIG. 9A, where a horizontal axis is a frame quantity, a vertical axis is a value of pos_max_L7_1, and F3 on the vertical axis is a lower limit of a derivative maximum value distribution parameter interval of frequency-domain energy distribution ratios of non-speech frames. It can be learned from FIG. 9B that derivative maximum value distribution parameter variation rules of frequency-domain energy distribution ratios of the normal speech frame and the non-speech-grade noise are similar. Therefore, determining needs to be performed according to the method described in this step. FIG. 9C is a parameter value curve of num_pos_hf, where a horizontal axis is a frame quantity, and a vertical axis is a value of num_pos_hf. It can be learned from FIG. 9C that values of num_pos_hf of non-speech-grade noise on the right of the dotted line 91 are obviously greater than N6.

Step S808: Determine that the current frame is non-speech-grade noise if M is greater than or equal to an eighth threshold.

As described above, if the quantity M of frames that are in the frame set consisting of the current frame and each frame in the preset neighboring domain range of the current frame and that satisfy the condition in step S807 is greater than or equal to the eighth threshold, it is determined that the current frame is non-speech-grade noise.

In summary, according to the noise detection method provided in this embodiment of the present disclosure, much noise that cannot be distinguished through time-domain waveform analysis can be detected by analyzing a frequency-domain energy distribution parameter of an audio signal, and further, speech-grade noise and non-speech-grade noise can be further distinguished based on tone parameters, so that after the noise is detected, the noise can be processed correspondingly.

Further, the noise detection method provided in this embodiment of the present disclosure may be further applied to voice quality monitoring (VQM). Because an existing assessment model of the VQM cannot cover in time all new speech-grade noise and cannot detect non-speech-grade noise that does not need to be rated, speech-grade noise that needs to be rated may be mistaken for a normal speech, thereby getting a relatively high rating, and non-speech-grade noise that has not been detected is also rated, resulting in an incorrect assessment result. If the noise detection method provided in this embodiment of the present disclosure is applied, speech-grade noise and non-speech-grade noise may be detected first, which avoids sending the speech-grade noise and the non-speech-grade noise to a rating module for rating, thereby improving assessment quality of the VQM.

Figure 10:
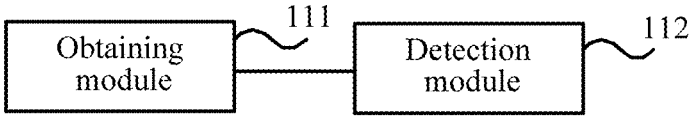
FIG. 10 is schematic structural diagram of a noise detection apparatus according to an embodiment of the present disclosure.

FIG. 10 is schematic structural diagram of a noise detection apparatus according to an embodiment of the present disclosure. As shown in FIG. 10, the noise detection apparatus provided in this embodiment includes: an obtaining module 111 configured to obtain a frequency-domain energy distribution parameter of a current frame of an audio signal, and obtain a frequency-domain energy distribution parameter of each of frames in a preset neighboring domain range of the current frame; obtain a tone parameter of the current frame, and obtain a tone parameter of each of the frames in the preset neighboring domain range of the current frame; and determine, according to the tone parameter of the current frame and the tone parameter of each of the frames in the preset neighboring domain range of the current frame, whether the current frame is in a speech section or a non-speech section; and a detection module 112 configured to determine that the current frame is speech-grade noise if the current frame is in a speech section and a quantity of frequency-domain energy distribution parameters falling within a preset speech-grade noise frequency-domain energy distribution parameter interval in all the frequency-domain energy distribution parameters is greater than or equal to a first threshold.

The noise detection apparatus provided in this embodiment of the present disclosure is configured to implement the technical solution in the method embodiment shown in FIG. 2, and their implementation principles and technical solutions are similar, which are not described herein again.

Optionally, the frequency-domain energy distribution parameter is a derivative maximum value distribution parameter of a frequency-domain energy distribution ratio, and the obtaining module 111 is configured to: obtain a frequency-domain energy distribution ratio of the current frame; calculate a derivative of the frequency-domain energy distribution ratio of the current frame; obtain a derivative maximum value distribution parameter of the frequency-domain energy distribution ratio of the current frame according to the derivative of the frequency-domain energy distribution ratio of the current frame; obtain a frequency-domain energy distribution ratio of each of the frames in the preset neighboring domain range of the current frame; calculate a derivative of the frequency-domain energy distribution ratio of each of the frames in the preset neighboring domain range of the current frame; and obtain a derivative maximum value distribution parameter of the frequency-domain energy distribution ratio of each of the frames in the preset neighboring domain range of the current frame according to the derivative of the frequency-domain energy distribution ratio of each of the frames in the preset neighboring domain range of the current frame; and the detection module 112 is configured to determine that the current frame is speech-grade noise if the current frame is in a speech section and a quantity of derivative maximum value distribution parameters of frequency-domain energy distribution ratios that fall within a preset derivative maximum value distribution parameter interval of speech-grade noise frequency-domain energy distribution ratios in all derivative maximum value distribution parameters of the frequency-domain energy distribution ratios is greater than or equal to a second threshold.

Optionally, the frequency-domain energy distribution parameter includes a frequency-domain energy distribution ratio and a derivative maximum value distribution parameter of the frequency-domain energy distribution ratio, and the obtaining module 111 is configured to: obtain a frequency-domain energy distribution ratio of the current frame; calculate a derivative of the frequency-domain energy distribution ratio of the current frame; obtain a derivative maximum value distribution parameter of the frequency-domain energy distribution ratio of the current frame according to the derivative of the frequency-domain energy distribution ratio of the current frame; obtain a frequency-domain energy distribution ratio of each of the frames in the preset neighboring domain range of the current frame; calculate a derivative of the frequency-domain energy distribution ratio of each of the frames in the preset neighboring domain range of the current frame; and obtain a derivative maximum value distribution parameter of the frequency-domain energy distribution ratio of each of the frames in the preset neighboring domain range of the current frame according to the derivative of the frequency-domain energy distribution ratio of each of the frames in the preset neighboring domain range of the current frame; and the detection module 112 is configured to determine that the current frame is speech-grade noise if the current frame is in a speech section, a quantity of derivative maximum value distribution parameters of frequency-domain energy distribution ratios that fall within a preset derivative maximum value distribution parameter interval of speech-grade noise frequency-domain energy distribution ratios in all derivative maximum value distribution parameters of the frequency-domain energy distribution ratios is greater than or equal to the second threshold, and a quantity of frequency-domain energy distribution ratios falling within a preset speech-grade noise frequency-domain energy distribution ratio interval in all the frequency-domain energy distribution ratios is greater than or equal to a third threshold.

Optionally, the detection module 112 is further configured to: use the current frame and each frame in the preset neighboring domain range of the current frame as a frame set; use each frame in the frame set as the current frame, and obtain a quantity N of frames in the frame set, where the frames are in a non-speech section, a quantity of frequency-domain energy distribution parameters falling within a preset non-speech-grade noise frequency-domain energy distribution parameter interval in all the frequency-domain energy distribution parameters is greater than or equal to a fourth threshold, and N is a positive integer; and determine that the current frame is non-speech-grade noise if N is greater than or equal to a fifth threshold.

Optionally, the frequency-domain energy distribution parameter is a derivative maximum value distribution parameter of a frequency-domain energy distribution ratio, and the obtaining module 111 is configured to: obtain a frequency-domain energy distribution ratio of the current frame; calculate a derivative of the frequency-domain energy distribution ratio of the current frame; obtain a derivative maximum value distribution parameter of the frequency-domain energy distribution ratio of the current frame according to the derivative of the frequency-domain energy distribution ratio of the current frame; obtain a frequency-domain energy distribution ratio of each of the frames in the preset neighboring domain range of the current frame; calculate a derivative of the frequency-domain energy distribution ratio of each of the frames in the preset neighboring domain range of the current frame; and obtain a derivative maximum value distribution parameter of the frequency-domain energy distribution ratio of each of the frames in the preset neighboring domain range of the current frame according to the derivative of the frequency-domain energy distribution ratio of each of the frames in the preset neighboring domain range of the current frame; and the detection module 112 is configured to: obtain a quantity M of frames in the frame set, where the frames are in a non-speech section, total frequency-domain energy is greater than or equal to a sixth threshold, a quantity of derivative maximum value distribution parameters of frequency-domain energy distribution ratios that fall within a preset derivative maximum value distribution parameter interval of non-speech-grade noise frequency-domain energy distribution ratios in all derivative maximum value distribution parameters of the frequency-domain energy distribution ratios is greater than or equal to a seventh threshold, and M is a positive integer; and determine that the current frame is non-speech-grade noise if M is greater than or equal to an eighth threshold.

Persons of ordinary skill in the art may understand that all or a part of the steps of the method embodiments may be implemented by a program instructing relevant hardware. The program may be stored in a computer readable storage medium. When the program runs, the steps of the method embodiments are performed. The foregoing storage medium includes any medium that can store program code, such as a read only memory (ROM), a random access memory (RAM), a magnetic disc, or an optical disc.

Finally, it should be noted that the foregoing embodiments are merely intended for describing the technical solutions of the present disclosure other than limiting the present disclosure. Although the present disclosure is described in detail with reference to the foregoing embodiments, persons of ordinary skill in the art should understand that they may still make modifications to the technical solutions described in the foregoing embodiments or make equivalent replacements to some technical features thereof, without departing from the scope of the technical solutions of the embodiments of the present disclosure.

What is claimed is:

1. A noise detection method, comprising:

obtaining a frequency-domain energy distribution parameter of a current frame of an audio signal, and obtaining a frequency-domain energy distribution parameter of each of frames in a preset neighboring domain range of the current frame;

obtaining a tone parameter of the current frame, and obtaining a tone parameter of each of the frames in the preset neighboring domain range of the current frame;

determining, according to the tone parameter of the current frame and the tone parameter of each of the frames in the preset neighboring domain range of the current frame, whether the current frame is in a speech section or a non-speech section; and determining the current frame is speech-grade noise when the current frame is in a speech section and a quantity of frequency-domain energy distribution parameters falling within a preset speech-grade noise frequency-domain energy distribution parameter interval in all the frequency-domain energy distribution parameters is greater than or equal to a first threshold, wherein the frequency-domain energy distribution parameter is a derivative maximum value distribution parameter of a frequency-domain energy distribution ratio, wherein obtaining the frequency-domain energy distribution parameter of the current frame of the audio signal comprises:

obtaining a frequency-domain energy distribution ratio of the current frame;

calculating a derivative of the frequency-domain energy distribution ratio of the current frame; and obtaining a derivative maximum value distribution parameter of the frequency-domain energy distribution ratio of the current frame according to the derivative of the frequency-domain energy distribution ratio of the current frame, wherein obtaining the frequency-domain energy distribution parameter of each of frames in the preset neighboring domain range of the current frame comprises:

obtaining a frequency-domain energy distribution ratio of each of the frames in the preset neighboring domain range of the current frame;

calculating a derivative of the frequency-domain energy distribution ratio of each of the frames in the preset neighboring domain range of the current frame; and obtaining a derivative maximum value distribution parameter of the frequency-domain energy distribution ratio of each of the frames in the preset neighboring domain range of the current frame according to the derivative of the frequency-domain energy distribution ratio of each of the frames in the preset neighboring domain range of the current frame, and wherein determining the current frame is speech-grade noise when the current frame is in the speech section and the quantity of frequency-domain energy distribution parameters falling within the preset speech-grade noise frequency-domain energy distribution parameter interval in all the frequency-domain energy distribution parameters is greater than or equal to the first threshold comprises determining the current frame is speech-grade noise when the current frame is in a speech section and a quantity of derivative maximum value distribution parameters of frequency-domain energy distribution ratios that fall within a preset derivative maximum value distribution parameter interval of speech-grade noise frequency-domain energy distribution ratios in all derivative maximum value distribution parameters of the frequency-domain energy distribution ratios is greater than or equal to a second threshold.

2. The method according to claim 1, further comprising:

using the current frame and each frame in the preset neighboring domain range of the current frame as a frame set;

using each frame in the frame set as the current frame, and obtaining a quantity N of frames in the frame set, wherein the frames are in a non-speech section, a quantity of frequency-domain energy distribution parameters falling within a preset non-speech-grade noise frequency-domain energy distribution parameter interval in all the frequency-domain energy distribution parameters is greater than or equal to a fourth threshold, and N is a positive integer; and determining the current frame is non-speech-grade noise when N is greater than or equal to a fifth threshold.

3. The method according to claim 2, wherein the frequency-domain energy distribution parameter is a derivative maximum value distribution parameter of a frequency-domain energy distribution ratio, wherein obtaining the frequency-domain energy distribution parameter of the current frame of the audio signal comprises:

obtaining a frequency-domain energy distribution ratio of the current frame;

calculating a derivative of the frequency-domain energy distribution ratio of the current frame; and obtaining a derivative maximum value distribution parameter of the frequency-domain energy distribution ratio of the current frame according to the derivative of the frequency-domain energy distribution ratio of the current frame, wherein obtaining the frequency-domain energy distribution parameter of each of frames in the preset neighboring domain range of the current frame comprises:

obtaining a frequency-domain energy distribution ratio of each of the frames in the preset neighboring domain range of the current frame;

calculating a derivative of the frequency-domain energy distribution ratio of each of the frames in the preset neighboring domain range of the current frame; and obtaining a derivative maximum value distribution parameter of the frequency-domain energy distribution ratio of each of the frames in the preset neighboring domain range of the current frame according to the derivative of the frequency-domain energy distribution ratio of each of the frames in the preset neighboring domain range of the current frame, wherein obtaining the quantity N of frames in the frame set, wherein the frames are in the non-speech section, the quantity of frequency-domain energy distribution parameters falling within the preset non-speech-grade noise frequency-domain energy distribution parameter interval in all the frequency-domain energy distribution parameters is greater than or equal to the fourth threshold, and N is the positive integer comprises obtaining a quantity M of frames in the frame set, wherein the frames are in a non-speech section, total frequency-domain energy is greater than or equal to a sixth threshold, a quantity of derivative maximum value distribution parameters of frequency-domain energy distribution ratios that fall within a preset derivative maximum value distribution parameter interval of non-speech-grade noise frequency-domain energy distribution ratios in all derivative maximum value distribution parameters of the frequency-domain energy distribution ratios is greater than or equal to a seventh threshold, and M is a positive integer, and wherein determining the current frame is non-speech-grade noise when N is greater than or equal to the fifth threshold comprises determining the current frame is non-speech-grade noise when M is greater than or equal to an eighth threshold.

4. The method according to claim 1, wherein obtaining the tone parameter of the current frame, and wherein obtaining the tone parameter of each of the frames in the preset neighboring domain range of the current frame comprises obtaining a largest tone quantity value, wherein the largest tone quantity value is a tone quantity of a frame whose tone quantity is the largest among the current frame and the frames in the preset neighboring domain range of the current frame, and wherein determining, according to the tone parameter of the current frame and the tone parameter of each of the frames in the preset neighboring domain range of the current frame, whether the current frame is in the speech section or the non-speech section comprises:

determining that the current frame is in a speech section when the largest tone quantity value is greater than or equal to a preset speech threshold; and determining that the current frame is in a non-speech section when the largest tone quantity value is smaller than a preset speech threshold.

5. A noise detection apparatus, comprising:

a memory storing executable instructions; and a processor coupled to the memory and configured to:

obtain a frequency-domain energy distribution parameter of a current frame of an audio signal;

obtain a frequency-domain energy distribution parameter of each of frames in a preset neighboring domain range of the current frame;

obtain a tone parameter of the current frame;

obtain a tone parameter of each of the frames in the preset neighboring domain range of the current frame;

determine, according to the tone parameter of the current frame and the tone parameter of each of the frames in the preset neighboring domain range of the current frame, whether the current frame is in a speech section or a non-speech section; and determine the current frame is speech-grade noise when the current frame is in a speech section and a quantity of frequency-domain energy distribution parameters falling within a preset speech-grade noise frequency-domain energy distribution parameter interval in all the frequency-domain energy distribution parameters is greater than or equal to a first threshold, wherein the frequency-domain energy distribution parameter is a derivative maximum value distribution parameter of a frequency-domain energy distribution ratio, and wherein the processor is further configured to:

obtain a frequency-domain energy distribution ratio of the current frame;

calculate a derivative of the frequency-domain energy distribution ratio of the current frame;

obtain a derivative maximum value distribution parameter of the frequency-domain energy distribution ratio of the current frame according to the derivative of the frequency-domain energy distribution ratio of the current frame;

obtain a frequency-domain energy distribution ratio of each of the frames in the preset neighboring domain range of the current frame;

calculate a derivative of the frequency-domain energy distribution ratio of each of the frames in the preset neighboring domain range of the current frame;

obtain a derivative maximum value distribution parameter of the frequency-domain energy distribution ratio of each of the frames in the preset neighboring domain range of the current frame according to the derivative of the frequency-domain energy distribution ratio of each of the frames in the preset neighboring domain range of the current frame; and determine that the current frame is speech-grade noise when the current frame is in a speech section and a quantity of derivative maximum value distribution parameters of frequency-domain energy distribution ratios that fall within a preset derivative maximum value distribution parameter interval of speech-grade noise frequency-domain energy distribution ratios in all derivative maximum value distribution parameters of the frequency-domain energy distribution ratios is greater than or equal to a second threshold.

6. The noise detection apparatus according to claim 5, wherein the processor is further configured to:

use the current frame and each frame in the preset neighboring domain range of the current frame as a frame set;

use each frame in the frame set as the current frame;

obtain a quantity N of frames in the frame set, wherein the frames are in a non-speech section, a quantity of frequency-domain energy distribution parameters falling within a preset non-speech-grade noise frequency-domain energy distribution parameter interval in all the frequency-domain energy distribution parameters is greater than or equal to a fourth threshold, and N is a positive integer; and determine the current frame is non-speech-grade noise when N is greater than or equal to a fifth threshold.

7. The noise detection apparatus according to claim 6, wherein the frequency-domain energy distribution parameter is a derivative maximum value distribution parameter of a frequency-domain energy distribution ratio, and wherein the processor is further configured to:

obtain a frequency-domain energy distribution ratio of the current frame;

calculate a derivative of the frequency-domain energy distribution ratio of the current frame;

obtain a derivative maximum value distribution parameter of the frequency-domain energy distribution ratio of the current frame according to the derivative of the frequency-domain energy distribution ratio of the current frame;

obtain a frequency-domain energy distribution ratio of each of the frames in the preset neighboring domain range of the current frame;

calculate a derivative of the frequency-domain energy distribution ratio of each of the frames in the preset neighboring domain range of the current frame;

obtain a derivative maximum value distribution parameter of the frequency-domain energy distribution ratio of each of the frames in the preset neighboring domain range of the current frame according to the derivative of the frequency-domain energy distribution ratio of each of the frames in the preset neighboring domain range of the current frame;

obtain a quantity M of frames in the frame set, wherein the frames are in a non-speech section, total frequency-domain energy is greater than or equal to a sixth threshold, a quantity of derivative maximum value distribution parameters of frequency-domain energy distribution ratios that fall within a preset derivative maximum value distribution parameter interval of non-speech-grade noise frequency-domain energy distribution ratios in all derivative maximum value distribution parameters of the frequency-domain energy distribution ratios is greater than or equal to a seventh threshold, and wherein M is a positive integer; and determine the current frame is non-speech-grade noise when M is greater than or equal to an eighth threshold.

8. The noise detection apparatus according to claim 5, wherein the processor is further configured to:

obtain a largest tone quantity value, wherein the largest tone quantity value is a tone quantity of a frame whose tone quantity is the largest among the current frame and the frames in the preset neighboring domain range of the current frame;

determine that the current frame is in a speech section when the largest tone quantity value is greater than or equal to a preset speech threshold; and determine that the current frame is in a non-speech section when the largest tone quantity value is smaller than a preset speech threshold.

9. A noise detection apparatus, comprising:

a memory storing executable instructions; and a processor coupled to the memory and configured to:

obtain a frequency-domain energy distribution parameter of a current frame of an audio signal;

obtain a frequency-domain energy distribution parameter of each of frames in a preset neighboring domain range of the current frame;

obtain a tone parameter of the current frame;

obtain a tone parameter of each of the frames in the preset neighboring domain range of the current frame;

determine, according to the tone parameter of the current frame and the tone parameter of each of the frames in the preset neighboring domain range of the current frame, whether the current frame is in a speech section or a non-speech section; and determine the current frame is speech-grade noise when the current frame is in a speech section and a quantity of frequency-domain energy distribution parameters falling within a preset speech-grade noise frequency-domain energy distribution parameter interval in all the frequency-domain energy distribution parameters is greater than or equal to a first threshold;

wherein the frequency-domain energy distribution parameter comprises a frequency-domain energy distribution ratio and a derivative maximum value distribution parameter of the frequency-domain energy distribution ratio, and wherein the processor is further configured to:

obtain a frequency-domain energy distribution ratio of the current frame;

calculate a derivative of the frequency-domain energy distribution ratio of the current frame;

obtain a derivative maximum value distribution parameter of the frequency-domain energy distribution ratio of the current frame according to the derivative of the frequency-domain energy distribution ratio of the current frame;

obtain a frequency-domain energy distribution ratio of each of the frames in the preset neighboring domain range of the current frame;

calculate a derivative of the frequency-domain energy distribution ratio of each of the frames in the preset neighboring domain range of the current frame;

obtain a derivative maximum value distribution parameter of the frequency-domain energy distribution ratio of each of the frames in the preset neighboring domain range of the current frame according to the derivative of the frequency-domain energy distribution ratio of each of the frames in the preset neighboring domain range of the current frame; and determine the current frame is speech-grade noise when the current frame is in a speech section, a quantity of derivative maximum value distribution parameters of frequency-domain energy distribution ratios that fall within a preset derivative maximum value distribution parameter interval of speech-grade noise frequency-domain energy distribution ratios in all derivative maximum value distribution parameters of the frequency-domain energy distribution ratios is greater than or equal to a second threshold, and a quantity of frequency-domain energy distribution ratios falling within a preset speech-grade noise frequency-domain energy distribution ratio interval in all the frequency-domain energy distribution ratios is greater than or equal to a third threshold.

* * * * *